US005973253A

United States Patent [19]

Hirata

[11] Patent Number: 5,973,253

[45] Date of Patent: Oct. 26, 1999

[54] ELECTRONIC MUSICAL INSTRUMENT FOR CONDUCTING AN ARPEGGIO PERFORMANCE OF A STRINGED INSTRUMENT

[75] Inventor: Takashi Hirata, Osaka, Japan

[73] Assignee: Roland Kabushiki Kaisha, Osaka, Japan

[21] Appl. No.: 08/946,112

[22] Filed: Oct. 7, 1997

[30] Foreign Application Priority Data

Oct. 8, 1996 [JP] Japan ..... 8-267602

[51] Int. Cl.[6] ..... G10H 1/28; G10H 7/00

[52] U.S. Cl. ..... 84/609; 84/615; 84/638; 84/742; 84/746

[58] Field of Search ..... 84/609–620, 634–638, 84/646, 722–746, DIG. 30

[56] References Cited

U.S. PATENT DOCUMENTS 4,653,376 3/1987 Allured et al. ..... 84/DIG. 30
5,025,703 6/1991 Iba et al. ..... 84/722 X
5,094,137 3/1992 Matsumoto ..... 84/615
5,121,668 6/1992 Segan et al. ..... 84/646
5,726,372 3/1998 Eventoff et al. ..... 84/609

*Primary Examiner*—Stanley J. Witkowski
*Attorney, Agent, or Firm*—Lyon & Lyon LLP

[57] ABSTRACT

An electronic musical instrument for conducting an arpeggio performance of a stringed instrument capable of readily producing a pattern for the arpeggio performance as one likes, and also of conducting the arpeggio performance which is perceived as being less musically incompatible even if the player makes a mistake during a performance of allocating of pitch at the time of the arpeggio performance. A pattern for the arpeggio performance is produced adopting such a rule that a time axis is renewed when all the strings become silent, or such a rule that it is regarded as having the same timing while a pedal is kept depressed. When the arpeggio performance is conducted, even if a mismatch occurs between the string of the pattern and the string played for a pitch allocation, those strings are compulsively allocated together.

18 Claims, 21 Drawing Sheets

| GRIDS / STRING Nos | 1 | 2 | 3 | 4 | 5 | · · · | n | n+1 |
|---|---|---|---|---|---|---|---|---|
| 1st STRING | 64 | 128 | 0 | 0 | 64 | · · · | 64 | 129 |
| 2nd STRING | 0 | 0 | 72 | 0 | 72 | · · · | 64 | 129 |
| 3rd STRING | 0 | 0 | 72 | 128 | 128 | · · · | 0 | 129 |
| 4th STRING | 64 | 72 | 64 | 128 | 0 | · · · | 0 | 129 |
| 5th STRING | 64 | 128 | 128 | 128 | 0 | · · · | 72 | 129 |
| 6th STRING | 72 | 0 | 72 | 128 | 0 | · · · | 72 | 129 |

Fig.4

| | |
|---|---|
| P(1) | STRENGTH OF 1st STRING |
| P(2) | STRENGTH OF 2nd STRING |
| P(3) | STRENGTH OF 3rd STRING |
| P(4) | STRENGTH OF 4th STRING |
| P(5) | STRENGTH OF 5th STRING |
| P(6) | STRENGTH OF 6th STRING |
| A | NUMBER OF STRINGS INVOLVED IN STRENGTH |

P(i)=0 INDICATES THAT 0 IS STORED AS THE STRING-PLAYING STRENGTH ASSOCIATED WITH i-th STRING
P(i)=128:Tie, P(i)==129:END

Fig.15

| | |
|---|---|
| S (1) | STRENGTH OF 1st STRING |
| S (2) | STRENGTH OF 2nd STRING |
| S (3) | STRENGTH OF 3rd STRING |
| S (4) | STRENGTH OF 4th STRING |
| S (5) | STRENGTH OF 5th STRING |
| S (6) | STRENGTH OF 6th STRING |
| B | NUMBER OF STRINGS PLAYED |

S(i)=0 INDICATES THAT i-th STRING IS NOT PLAYED

Fig.16

| | | |
|---|---|---|
| U(1) | STRENGTH OF 1st STRING | STRENGTH OF 1st STRING |
| U(2) | STRENGTH OF 2nd STRING | STRENGTH OF 2nd STRING |
| U(3) | STRENGTH OF 3rd STRING | STRENGTH OF 3rd STRING |
| U(4) | STRENGTH OF 4th STRING | STRENGTH OF 4th STRING |
| U(5) | STRENGTH OF 5th STRING | STRENGTH OF 5th STRING |
| U(6) | STRENGTH OF 6th STRING | STRENGTH OF 6th STRING |

U(i)=0 INDICATES THAT NO STRING ALLOCATED EXISTS

U(i)=128:Tie

Fig.17

| | | | | | | | |
|---|---|---|---|---|---|---|---|
| | i | 6 | 5 | 4 | 3 | 2 | 1 |
| VIBRATING STRINGS | S(i) | | △ | △ | | △ | △ |
| PATTERNS | P(i) | ○ | | ○ | ○ | ○ | ○ |

Fig.18

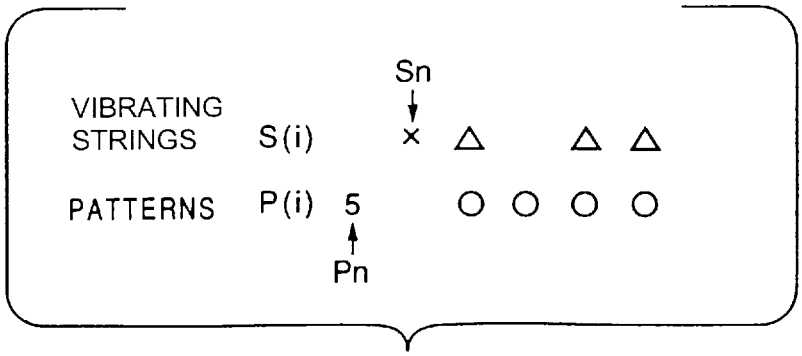

Fig.19

| | | | | | | | | | |
|---|---|---|---|---|---|---|---|---|---|
| | | | | | | Sn | | | |
| VIBRATING STRINGS | S(i) | | × | * | × | △ | △ | REMNANT | B=2 |
| PATTERNS | P(i) | 5 | | | 3 | | ○ | | A=1 |
| | | | | | | Pn | | | |

Fig.36

| | | | | | | | | | |
|---|---|---|---|---|---|---|---|---|---|
| | | | | | | | Sn | | |
| VIBRATING STRINGS | S(i) | | × | * | × | * | △ | REMNANT | B=1 |
| PATTERNS | P(i) | 5 | | | 3 | | ○ | | A=1 |
| | | | | | | | Pn | | |

Fig.37

| | | | | | | | |
|---|---|---|---|---|---|---|---|
| VIBRATING STRINGS | S(i) | | × | * | × | * | × |
| PATTERNS | P(i) | 5 | | | 3 | | 1 |

Fig.38

| | i | 6 | 5 | 4 | 3 | 2 | 1 |
|---|---|---|---|---|---|---|---|
| VIBRATING STRINGS | S(i) | | △ | △ | | △ | △ |
| PATTERNS | P(i) | ○ | | ○ | ○ | ○ | ○ |

Fig.39

| | | | | | | | |
|---|---|---|---|---|---|---|---|
| VIBRATING STRINGS | S(i) | | △ | × | | × | × |
| PATTERNS | P(i) | ○ | | 4 | ○ | 2 | 1 |

Fig.40

| | | | | | | | |
|---|---|---|---|---|---|---|---|
| VIBRATING STRINGS | S(i) | | × | × | | × | × |
| PATTERNS | P(i) | 5 | | 4 | 2 | 2 | 1 |

Fig.41

ELECTRONIC MUSICAL INSTRUMENT FOR CONDUCTING AN ARPEGGIO PERFORMANCE OF A STRINGED INSTRUMENT

BACKGROUND OF THE INVENTION

1. Field of the Invention

The present invention relates to an electronic musical instrument to which an electronic stringed instrument having a string vibration sensor, such as a electric guitar and the like, is connected, or which is formed in integration with such an electronic stringed instrument, and more particularly, an electronic musical instrument having a function referred to as an arpeggiator.

2. Description of the Related Art

Hitherto, there is known an electronic musical instrument having a function referred to as an arpeggiator. An arpeggiator means such a function that inputted or generated pitch information is associated with a predetermined arpeggio (broken chord) whose pattern and timing of sounds is controlled to automatically perform the arpeggio playing. Of the electronic musical instruments having the function of such an arpeggiator, there is known an electronic musical instrument to which an electronic stringed instrument, such as an electric guitar and the like, is connected (cf. Japanese Patent Laid Open Gazette Sho. 53-60625).

According to the conventional electronic musical instrument connected to an electronic stringed instrument for performing the arpeggio function, it would be difficult to make up arpeggio patterns as one likes, or even if it is possible to make up arpeggio patterns as one likes, there is a need to make up arpeggio patterns with very difficult schemes. This is not easy for a performer of the electronic stringed instrument to deal with.

Further, when the arpeggio playing is performed, pitch information is obtained by playing strings of electronic musical instruments, and the pitch information thus obtained is associated with an arpeggio pattern prepared beforehand. However, in the event that the associated string is not played, there is a possibility that musically unnatural incomplete arpeggio playing is inadvertently performed in such a manner that sounds are partially omitted.

SUMMARY OF THE INVENTION

In view of the foregoing, it is therefore an object of the present invention to provide an electronic musical instrument having an arpeggiator function capable of readily making up desired arpeggio patterns as one likes.

It is another object of the present invention to provide an electronic musical instrument having the arpeggiator function capable of performing arpeggio playing which is perceived as being less musically incompatible in such a manner that even if a string, which is to be essentially played for the arpeggio playing according to a predetermined arpeggio pattern, is not played, sounds are not omitted.

FIG. 1 is a principal block diagram of an electronic musical instrument having functions of the first to fourth embodiments of the electronic musical instrument according to the present invention, which will be described hereinafter.

An electronic musical instrument 10 is connected to a stringed instrument 20 in any of the first to fourth electronic musical instruments according to the present invention. The stringed instrument 20 comprises a plurality of strings 21_1, 21_2, . . . 21_n, and an associated plurality of sensors 22_1, 22_2, . . . 22_n. Each of these sensors 22_1, 22_2, . . . 22_n pick-up a vibration (vibrating string) of the associated one of the strings 21_1, 21_2, . . . 21_n so as to generate vibrating string signals.

According to the first to third electronic musical instrument embodiments of the present invention, the electronic musical instrument 10 comprises a basic structure having a pattern generation mode for generating patterns each representative of change with lapse of time of a played string of the stringed instrument 20 in accordance with vibrating string signals, each of which corresponds to the associated one of the plurality of strings 21_1, 21_2, . . . 21_n, of the stringed instrument 20, and a musical tone generation mode for generating musical tone signals in accordance with the singing string signals, each of which corresponds to the associated one of the plurality of strings 21_1, 21_2, . . . 21_n of the stringed instrument 20 and the patterns generated in the pattern generation mode.

In the fourth electronic musical instrument embodiment of the present invention, while it is acceptable that the musical instrument has both the pattern generation mode and the musical tone generation mode, it is also acceptable that the patterns are preset beforehand and the musical instrument has only a function corresponding to the musical tone generation mode, of the pattern generation mode or and the musical tone generation mode.

The first electronic musical instrument embodiment of the electronic musical instruments of the present invention has the basic structure as mentioned above in which a pattern storage means 11 and a data writing means 12 are provided.

The pattern generated in the pattern generation mode is defined by an arrangement associated with said plurality of strings 21_1, 21_2, . . . 21_n and an arrangement associated with a plurality of grids indicative of a direction on a time elapse basis, wherein each of coordinate points designated by the strings and the grids has string mapping data including information representative of whether a string associated with each of the coordinate points is played in a grid associated with each of the coordinate points. The pattern storage means 11 stores the pattern as mentioned above in said pattern generation mode.

In the pattern as mentioned above, basically, each of coordinate points designated by the strings and the grids has string mapping data including information representative of whether a string associated with each of the coordinate points is played in a grid associated with each of the coordinate points. According to the present invention, however, it is permissible for that each of coordinate points designated by the strings and the grids to have other data. For example, according to the embodiments which will be described later, there are stored therein end data indicative of the termination of the arrangement in a grid-direction, and continuation data (tie data) indicating that the performance on the immediately preceding grid is to be continued.

Further, the data writing means 12 of the first embodiment of the electronic musical instrument is operative in said pattern generation mode for writing string mapping data including information representative of whether the plurality of strings 21_1, 21_2, . . . 21_n is played after a time in which any one of the strings is played in a state that the vibrations (string singing) of all the plurality of strings 21_1, 21_2, . . . 21_n are stopped before a time in which the vibrations (string vibrating) of all the plurality of strings 21_1, 21_2, . . . 21_n are next stopped, into respective coordinate points associated with a present grid indicated by a grid-direction of writing pointer and also associated with the plurality of strings 21_1, 21_2, . . . 21_n, and responsive to a stop of the vibrations (string vibrating) of all of the plurality of strings 21_1, 21_2, . . . 21_n for incrementing said writing pointer by one in a grid-direction.

Incidentally, in the data writing means 12, while it is acceptable that the respective string mapping data are written into all of the respective coordinate points associated with a one grid and also associated with the plurality of strings 21_1, 21_2, . . . 21_n in the same timing, this is not required. It is also acceptable, for example, as exemplarily shown in the embodiment which will be described later, that string mapping data indicating no string-singing are written into all of the coordinate points beforehand, and in timing when a string is actually played, string mapping data (in the present invention, of string mapping data indicating whether a string-playing occurs, string mapping data indicative of occurrence of the string-playing is referred to as string-playing data) indicative of occurrence of the string-playing is written into the coordinate point associated with the string played.

According to the first embodiment of the electronic musical instrument, a string-playing, which occurs during a period of time after a time in which any one of the strings is played in a state when the vibration of all the plurality of strings is stopped before a time in which the vibration of all the plurality of strings is next stopped, is regarded as the same timing of string-playing on a time axis basis. Thus, it is possible to readily produce a pattern based on a player's performance as one likes. Further, according to the first embodiment of the electronic musical instrument, there may be produced a pattern in which a string-playing, which occurs within a certain time duration (a time duration from the string-playing of any one of strings to the termination of the vibration of all of the strings), is regarded as the same timing (the same grid) of string-playing on a time axis basis. This feature makes it possible to implement an arpeggio performance remarkably abounding in variations as will be described later in the embodiments.

In the first embodiment of the electronic musical instrument, it is preferable that the electronic musical instrument further comprises a predetermined first handler, wherein said data writing means, in response to an operation of said first handler, writes, into coordinate points associated with coordinate points in which string-playing data indicating that a string is played is written of a plurality of coordinate points associated with an immediately previous grid, of a plurality of coordinate points associated with a present grid, continuation data indicating that a generation of a musical tone based on string mapping data written in said musical tone generation mode into coordinate points associated with an immediately previous grid and also associated with an identical string is continued also on the present grid, and incrementing said writing pointer by one in a grid-direction.

This feature makes it possible to produce a pattern having a larger degree of freedom thereby implementing an arpeggio performance more abounding in variations.

Further, in the first electronic musical instrument, it is preferable that of said string mapping data, string-playing data indicating that a string is played is data representative also of the strength or vigor with which a performer play.

This feature makes it possible to implement an arpeggio performance abounding in variations also with respect to the vigor desired by a player.

Next, there will be described a second electronic musical instrument embodiment of the electronic musical instruments according to the present invention.

While the second electronic musical instrument embodiment will also be explained, for the sake of convenience, referring to the functional block of FIG. 1 which was referred to when the first electronic musical instrument embodiment was explained above, it happens that functions of the functional blocks are different from those of the first electronic musical instrument embodiment.

The second electronic musical instrument embodiment of the present invention has a pattern generation mode and a musical tone generation mode, as mentioned above, and a pattern storage means 11, a data writing means 12 and a handler 13.

Types of the patterns and the function of the pattern storage means 11 in the second electronic musical instrument embodiment of the present invention are the same as those in the first electronic musical instrument embodiment of the present invention mentioned above. Thus the redundant description will be omitted.

Incidentally, the handler 13 in the second electronic musical instrument embodiment of the present invention is not different per se from the handler 13, if provided, in the first electronic musical instrument embodiment of the present invention mentioned above, but it is different in the way the handler is used by the data writing means 12.

In the second electronic musical instrument of the present invention, the data writing means 12 is operative in said pattern generation mode for writing string mapping data including information representative of whether the plurality of strings 21_1, 21_2, . . . 21_n is played after an operation to start timing of said second hander before an operation to terminate timing of said second hander 13, into respective coordinate points associated with a present grid indicated by a grid-direction of writing pointer and also associated with the plurality of strings 21_1, 21_2, . . . 21_n, and responsive to a termination of an operation of said second handler 13 for incrementing said writing pointer by one in a grid-direction.

Also in the data writing means 12 of the second electronic musical instrument embodiment of the present invention, in a similar fashion to the data writing means 12 of the first electronic musical instrument embodiment of the present invention mentioned above, while it is acceptable that the respective string mapping data are written into all of the respective coordinate points associated with one grid and also associated with the plurality of strings 21_1, 21_2, . . . 21_n in the same timing, this is not mandatory. It is also acceptable, for example, as exemplarily shown in the embodiment which will be described later, that string mapping data indicating no string-vibrating are written into the whole coordinate points beforehand, and in timing when a string is actually played, string mapping data (string-playing data) indicative of the occurrence of string-playing is written into the coordinate point associated with the string played.

According to the second electronic musical instrument, a string-playing, which occurs during a period of time from a timing of an operation to start the handler 13 to a timing of an operation to terminate of the handler 13, is regarded as having the same timing of string-playing on a time axis basis. Thus, similar to the first electronic musical instrument, it is possible to readily produce a pattern based on a player's performance as one likes. Further, according to the second electronic musical instrument, similar to the first electronic musical instrument, it is possible to implement an arpeggio performance remarkably abounding in variations as will be described later in the embodiments.

In the second electronic musical instrument, it is preferable that in the event that one or more of said plurality of strings 21_1, 21_2, . . . 21_n is vibrated (string vibrating) in the operation to start timing of said second hander, said data writing means 12 writes, into coordinate points associated with a present grid and associated with the vibrated string, continuation data indicating a generation of a musical tone based on string mapping data written in said musical tone generation mode into coordinate points associated with an immediately previous grid and also associated with an identical string is continued also on the present grid.

This feature makes it possible, similar to a case where the handler 13 is provided in the first electronic musical instrument, and the handler 13 is operated, to produce a pattern having a larger degree of freedom thereby implementing an arpeggio performance more abounding in variations. Incidentally, according to the first electronic musical instrument, the continuation data (tie data) is written onto a one grid in its entirety. On the other hand, according to the second electronic musical instrument, it is possible to select whether the continuation data (tie data) is to be written for each string onto a one grid. Thus, it is possible to produce a pattern having a further higher degree of freedom.

Further, in the second electronic musical instrument, it is preferable, similar to the above-mentioned first electronic musical instrument, that of said string mapping data, string-playing data indicating that a string is played is data representative also of the strength with which a performer played.

This feature makes it possible to implement an arpeggio performance abounding in variations with respect to the strength of string-playing as a player likes.

Next, there will be described a third electronic musical instrument embodiment of the electronic musical instruments according to the present invention.

While the third electronic musical instrument will also be explained, for the sake of convenience, referring to the functional block of FIG. 1 which was referred to when the first and second electronic musical instruments were explained above, it happens that functions of the functional blocks are different from those of the first and second electronic musical instruments.

The third electronic musical instrument embodiment of the present invention has a pattern generation mode and a musical tone generation mode, as mentioned above, and a pattern storage means 11 and a data writing means 12.

Types of the patterns and the function of the pattern storage means 11 in the third electronic musical instrument embodiment of the present invention are the same as those in the first and second embodiments of the electronic musical instruments of the present invention mentioned above. Thus the redundant description will be omitted.

In the third electronic musical instrument embodiment of the present invention, the data writing means 12 is operative in said pattern generation mode for writing string mapping data including information representative of whether the plurality of strings 21_1, 21_2, . . . 21_n is played during a period of time since a grid-direction of writing pointer was advanced the last time up to the present time, into respective coordinate points associated with a present grid indicated by said writing pointer and also associated with the plurality of strings 21_1, 21_2, . . . 21_n, and for incrementing said writing pointer by one in a grid-direction at regular time intervals.

Also in the data writing means 12 of the third electronic musical instrument embodiment of the present invention, in a similar fashion to the data writing means 12 of the first and second embodiments of the electronic musical instruments of the present invention mentioned above, while it is acceptable that the respective string mapping data are written into all of the respective coordinate points associated with a one grid and also associated with the plurality of strings 21_1, 21_2, . . . 21_n in the same timing, this is not mandatory. It is also acceptable, for example, as exemplarily shown in the embodiment which will be described later, that string mapping data indicating no string-vibrating are written into the whole coordinate points beforehand, and in timing when a string is actually played, string mapping data (string-playing data) indicative of the occurrence of the string-playing is written into the coordinate point associated with the string played.

According to the third electronic musical instrument, a string-playing, which occurs during a predetermined time interval, is regarded as having the same timing of string-playing on a time axis basis. Thus, similar to the first and second electronic musical instruments, it is possible to readily produce a pattern based on a player's performance as one likes. Further, according to the third electronic musical instrument, similar to the first and second electronic musical instruments, it is possible to implement an arpeggio performance remarkably abounding in variations as will be described later in the embodiments.

In the third electronic musical instrument, it is preferable that in the event that one or more of said plurality of strings 21_1, 21_2, . . . 21_n is vibrated (string vibrating) in a timing in which said writing pointer is incremented by one in the grid-direction, said data writing means writes, into coordinate points associated with a present grid and associated with the vibrated string, continuation data indicating a generation of a musical tone based on string mapping data written in said musical tone generation mode into coordinate points associated with an immediately previous grid and also associated with an identical string is continued also on the present grid.

This feature makes it possible, similar to a case where the handler 13 is provided in the first electronic musical instrument and the handler 13 is operated, or similar to the second electronic musical instrument, to produce a pattern having a larger degree of freedom thereby implementing an arpeggio performance more abounding in variations. Incidentally, according to the third electronic musical instrument, similar to the above-mentioned second electronic musical instrument, it is possible to select whether the continuation data (tie data) is to be written for each string onto a one grid. Thus, it is possible to produce a pattern having a further higher degree of freedom.

Further, in the third electronic musical instrument, it is preferable, similar to the above-mentioned first and second electronic musical instruments, that of said string mapping data, string-playing data indicating that a string is played includes data representative also of the strength of string-playing.

This feature makes it possible to implement an arpeggio performance abounding in variations with respect to the strength of string-playing as a player likes.

As the fourth electronic musical instrument embodiment of the present invention, there is provided an electronic musical instrument wherein a stringed instrument 20 has a plurality of strings 21_1, 21_2, . . . 21_n and a plurality of sensors 22_1, 22_2, . . . 22_n each corresponding to an associated one of the plurality of strings for picking up a vibration of the associated string to generate a vibrating string signal, and musical tone signals are generated in accordance with vibrating string signals each corresponding to the associated string, and a pattern representative of change with the elapse of time of played strings of said stringed instrument, said electronic musical instrument comprising: pattern storage means 11, data reading means 14, mapping means 15 and musical tone generation means 16.

Pattern storage means 11 stores the pattern, the pattern being defined by an arrangement associated with said plurality of strings and an arrangement associated with a plurality of grids indicative of a direction on a time elapse basis, wherein each of coordinate points designated by the strings and the grids has string mapping data including information representative of whether a string associated with each of the coordinate points is played in a grid associated with each of the coordinate points.

Data reading means 14 reads the patterns stored in said pattern storage means 11.

Mapping means 15 provides a mapping between string-playing data indicating that an associated string is played, of string mapping data associated with said plurality of strings 21_1, 21_2, . . . 21_n read out from said data reading means 14, and a vibrating string of said plurality of strings 21_1, 21_2, . . . 21_n, regardless of the fact that the string associated with the string-playing data and the vibrating string match with one another; and Musical tone generation means 16 generates a musical tone signal of a pitch of a vibrating string associated with the string-playing data of the string mapping data associated with said plurality of strings 21_1, 21_2, . . . 21_n read out from said data reading means 14.

According to the fourth electronic musical instrument, there is provided the mapping means 15. The use of the mapping means 15 prevents an omission of the musical tone, even if a mismatch between the string associated with the string-playing data and the string played for an indication of pitch exists, thereby removing a disharmony.

The musical tone generated in the musical tone generation means 16 is fed to the sound system 30, amplified by the amplifier 31 and then emanated to the space in the form of musical sounds by the speaker 32.

Incidentally, in FIG. 1, while the sound system 30 is separate from the electronic musical instrument 10, it is acceptable that the sound system 30 is incorporated into the electronic musical instrument 10.

In the fourth electronic musical instrument, it is preferable that said string-playing data indicates that a string is played and is representative of the strength of string-playing, and said musical tone generation means 16 generates the musical tone signal of a pitch of a vibrating (string-vibrating) string associated with the string-playing data and of a sounding strength according to the strength of the string-playing indicated by said string-playing data.

This feature makes it possible to implement an arpeggio performance abounding in variations also with respect to the strength of string-playing.

Further, in the fourth electronic musical instrument, it is preferable that said mapping means 15 provides a mapping between string-playing data associated with a lowest tone string of the string-playing data read out by said data reading means 14, and a string associated with the lowest tone string of vibrating (string-vibrating) strings.

In the arpeggio performance of the guitar of interest of the present invention, it often happens that as the lowest tone, a root tone having a musically significant meaning is played, and in addition, the lowest tone is played in the string playing pattern independently of the string playing pattern of another string. Consequently, a mapping between the string playing data associated with the lowest tone string and the lowest tone string of the singing strings makes it possible to implement an arpeggio performance almost involving no sense of incompatibility, even if a mismatch between the strings occurs.

Further, in the fourth electronic musical instrument, it is preferable that said mapping means 15 provides a mapping between string-playing data read out from said data reading means 14 and a vibrating string in such a manner that a maximum number of combinations of string-playing data and the vibrating string identical with a string associated with the string-playing data, or of higher tone than the string can be obtained.

Performing such a mapping brings about such a tendency that an arpeggio (broken chord) to be sounded shifts at least a part to the high tone side, and as a result, a clear (broken chord) is sounded. Further, it is possible to reduce such a possibility that a musical tone associated with a high tone, which is significant in another meaning on the arpeggio performance, is not sounded although it is played, and becomes useless. Thus, it is possible to implement a preferable arpeggio performance.

Alternatively, in the fourth electronic musical instrument, it is also preferable that said mapping means 15 provides a mapping between string-playing data read out from said data reading means 14 and a vibrating string in such a manner that a maximum number of combinations of string-playing data and the vibrating string identical with a string associated with the string-playing data can be obtained.

According to this mapping scheme, it is possible to generate musical tone signals associated with the strings defined in the pattern as far as possible, and thus it is effective in the event that a performance faithful to the pattern is desired.

As explained, according to the first, second and third electronic musical instruments, it is possible to readily produce a desired arpeggio pattern as one likes.

Further, according to the fourth electronic musical instrument, when an arpeggio performance is conducted in accordance with a predetermined arpeggio pattern, it is possible, even if the string, which is to be essentially played for the arpeggio performance, is not played, to prevent an omission of sounds, thereby conducting the arpeggio performance with less perceived incompatibility.

BRIEF DESCRIPTION OF THE DRAWINGS

FIG. 4 is a view showing by way of example an arpeggio pattern generated in the pattern storage unit shown in FIG. 3;

FIG. 15 is a view showing storage areas for data of the respective strings of the present grid read out from an arpeggio pattern, and a working area for storing the number of strings subjected to a string-playing;

FIG. 16 is a view showing storage areas for pitch data showing the present performance pattern for a pitch designation, and a working area for storing the number of strings subjected to a string-playing;

FIG. 17 is a view showing string-playing strength of the respective strings after remapping;

FIG. 18 is an explanatory view showing in order remapping of a certain one pattern;

FIG. 19 is an explanatory view showing in order remapping of a certain one pattern;

FIG. 36 is an explanatory view showing in order remapping of a one pattern;

FIG. 37 is an explanatory view showing in order remapping of a one pattern;

FIG. 38 is an explanatory view showing in order remapping of a one pattern;

FIG. 39 is an explanatory view for an allocation method different from that in the flowchart shown in FIG. 14;

FIG. 40 is an explanatory view for an allocation method different from that in the flowchart shown in FIG. 14;

FIG. 41 is an explanatory view for an allocation method different from that in the flowchart shown in FIG. 14;

DESCRIPTION OF THE PREFERRED EMBODIMENTS

Hereinafter, there will be described embodiments of the present invention.

Figure 2:
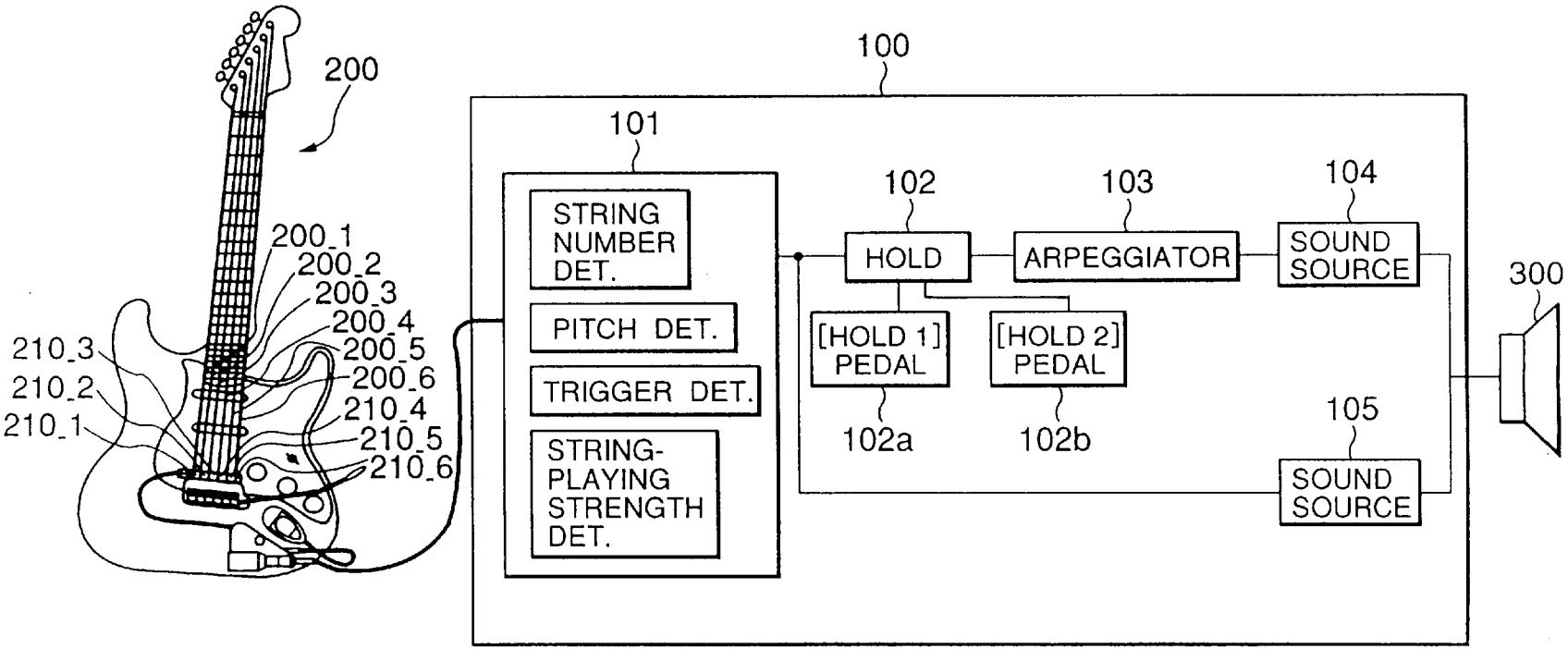
FIG. 2 is a block diagram showing an embodiment of an electronic musical instrument putting together the first to fourth electronic musical instrument embodiments according to the present invention.

FIG. 2 is a block diagram showing an embodiment of an electronic musical instrument putting together the first to fourth electronic musical instrument embodiments according to the present invention.

In FIG. 2, connected to an electronic musical instrument 100 are a guitar 200 and a sound system 300.

Figure 1:
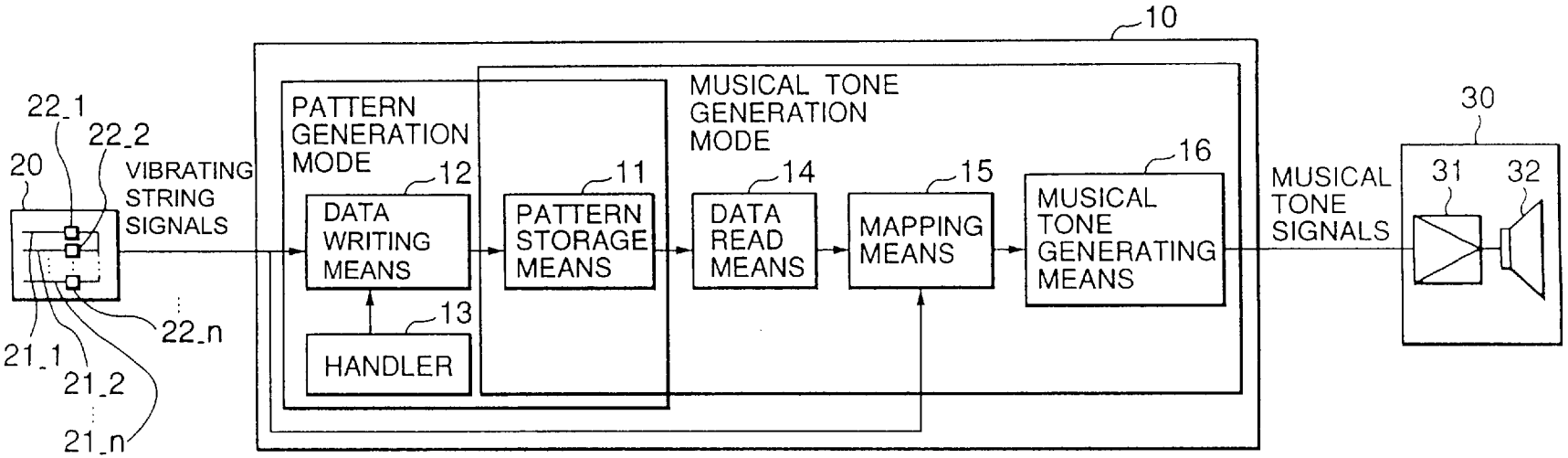
FIG. 1 is a principle block diagram of an electronic musical instrument having functions of the first to fourth electronic musical instrument embodiments according to the present invention.

The guitar 200, which corresponds to the stringed instrument 20 shown in FIG. 1, comprises six strings 200_1, 200_2, . . . 200_6, which correspond to the plurality of strings 21_1, 21_2, . . . 21_n of the stringed instrument 20 shown in FIG. 1, respectively, and six associated sensors 210_1, 210_2, . . . 210_6 which correspond to the associated plurality of sensors 22_1, 22_2, . . . 22_n of the stringed instrument 20 shown in FIG. 1, respectively. Each of these six sensors pick-up a vibrating string of the associated one of the strings so as to generate vibrating string signals which are fed to the electronic musical instrument 100.

A detecting unit 101 of the electronic musical instrument 100 performs, based on the received vibrating string signals, a detection (string number detection) of the numbers (1–6) of strings being played, a detection (pitch detection) of the pitch of strings subjected to string-playing, a detection (trigger detection) of the timing of string-playing of the respective strings, and a detection (string-playing strength detection) of the string-playing strength of the respective strings. Thus, there is generated performance information comprising string number information, pitch information, trigger information and string-playing strength information in accordance with a detection result of the detecting unit 101.

The performance information generated by the detecting unit 101 is supplied to a hold unit 102 and a sound source 105.

The sound source 105 generates musical tone signals based on the input performance information according to the present singing string.

Connected to the hold unit 102 are two hold pedals, that is, [Hold 1] pedal 102*a* and [Hold 2] pedal 102*b*.

When none of [Hold 1] pedal 102*a* and [Hold 2] pedal 102*b* is operated, the hold unit 102 serves to pass the input performance information therethrough to an arpeggiator 103. When [Hold 1] pedal 102*a* is stepped on, the hold unit 102 holds (temporarily stores therein) the performance information which is fed to the hold unit 102 at the time point when [Hold 1] pedal 102*a* is stepped on, and continues to output the stored performance information to the arpeggiator 103, so that even if the performance information is changed as the performance of the guitar 200 progresses, the changed performance information is not transmitted to the arpeggiator 103. In connection with the holding of performance information in the hold unit 102 by [Hold 1] pedal 102*a*, the electronic musical instrument 100 has two modes. In one of the two modes, performance information is held only while [Hold 1] pedal 102*a* is stepped on, and holding is released when a player removes one's foot from [Hold 1] pedal 102*a*. In another mode, when [Hold 1] pedal 102*a* is stepped on once, performance information is held, and holding is released when a player removes one's foot from [Hold 1] pedal 102*a* and again steps on [Hold 1] pedal 102*a*.

Holding performance information through an operation of [Hold 1] pedal 102*a* permits the arpeggiator 103 to continue an arpeggio performance based on the performance information thus held, and causes performance information according to the present vibrating strings to be fed to the sound source 105 only so that the sound source 105 generates musical tone signals based on the performance information.

In this case, it is possible to effect a performance in which arpeggio performance sounds based on the performance information held by the hold unit 102 are superimposed upon playing sounds of the guitar 200.

When [Hold 2] pedal 102*b* is stepped on, entered performance information is held for each string while [Hold 2] pedal 102*b* is stepped on, even after the string has stopped singing. And when new performance information is entered for the string, the old held performance information is replaced by the new performance information.

According to the arpeggiator in the electronic musical instrument 100, the arpeggio performance starts when strings are played, and it terminates when strings have stopped vibrating. Consequently, for example, when $G_{major}$ is played after $C_{major}$ is played, once the vibrating of $C_{major}$ is stopped before playing $G_{major}$, this involves such a result that the arpeggio performance is terminated at that time. In such a case, stepping on [Hold 2] pedal 102*b* makes it possible to avoid the situation such that the arpeggio performance is inadvertently terminated, and when $G_{major}$ is played, to transfer to the arpeggio performance involved in a pitch of $G_{major}$.

Incidentally, according to the present embodiment, [Hold 2] pedal 102*b* is effectively operative even in the state when performance information is held in the hold unit 102 by an operation of [Hold 1] pedal 102*a*, and when [Hold 2] pedal 102*b* is stepped on and then a new string-playing is carried out, the performance information held in the hold unit 102 is replaced by a new performance information generated in association with the new string-playing.

In this manner, according to the electronic musical instrument 100 of the present embodiment, holding a new performance information in the hold unit 102 makes it possible to carry out such a performance that an arpeggio performance is superimposed on a performance of a guitar while the arpeggio performance is altered.

The arpeggiator 103 generates performance information associated with an arpeggio performance and transmits the same to a sound source 104. The sound source 104 produces a musical tone signal according to the entered performance information. The musical tone signal produced in the sound source 104 is synthesized with the musical tone signal produced in the sound source 105, and the synthesized musical tone signals are outputted from the electronic musical instrument 100 so as to emanate through a sound system 300 in the form of a musical tone.

Figure 3:
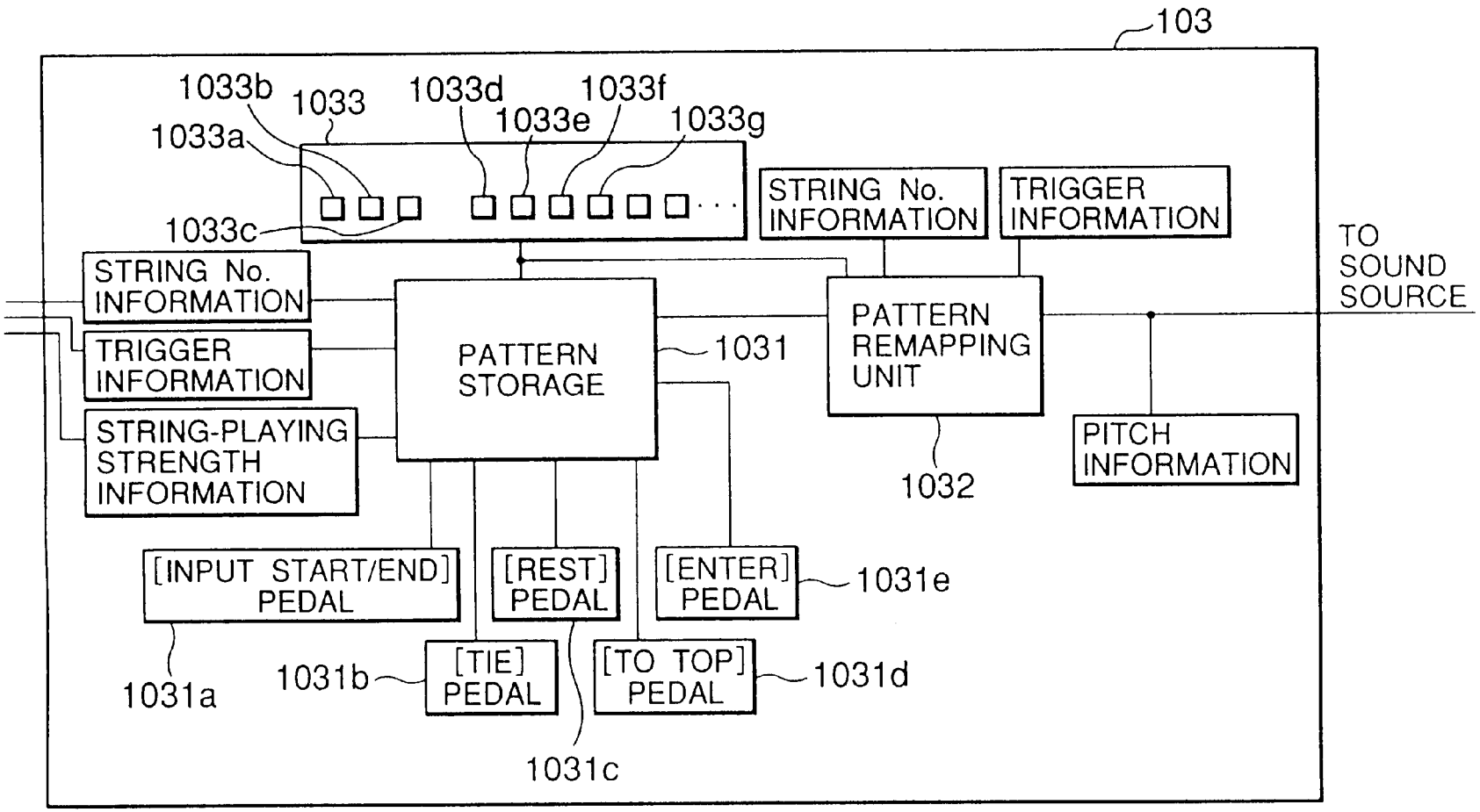
FIG. 3 is a functional block diagram of the arpeggiator shown by a block in FIG. 2.

FIG. 3 is a functional block diagram of the arpeggiator 103 shown as a block in FIG. 2.

The arpeggiator 103 shown in FIG. 3 comprises a pattern storage unit 1031 and a pattern remapping unit 1032. The pattern storage unit 1031 is provided with five pedals, that is, [Input start/end] pedal 1031*a*, [Tie] pedal 1031*b*, [Rest] pedal 1031*c*, [To Top] pedal 1031*d*, and [Enter] pedal 1031*e*. The function of these five pedals 1031*a*–1031*e* will be described later. The pattern storage unit 1031 serves, in the pattern generation mode, to generate and store therein arpeggio patterns in accordance with string number information, trigger information and string-playing strength information. The details will be described later.

The pattern remapping unit 1032 serves, in the musical tone generation mode, to carry out based on an arpeggio pattern read out from the pattern storage unit 1031 in accordance with an operating speed set up by a tick set up handler 1033*f* and a grid set up handler 1033*g*, and string information and trigger information according to the performance of the guitar 200, a mapping ("remapping" which will be described latter) of a string number in the arpeggio pattern thus read out to a string number involved in the present performance. Performance information consisting of a mapping result and pitch information by the present performance is transmitted to the sound source 104 (FIG. 2). The sound source 104 produces musical tone signals for the arpeggio performance according to the pitch information for each string and the associated arpeggio pattern on the basis of the performance information transmitted. The operation of the pattern remapping unit 1032 will be explained in detail later.

The arpeggiator 103 further comprises a control panel 1033. The control panel 1033 has a mode selection handler group consisting of a first mode selection handler 1033*a* for performing a changeover between a pattern generation mode for generating arpeggio patterns and a musical tone generation mode for generating musical tone signals based on the generated pattern; a second mode selection handler 1033*b* for performing a changeover between types of input schemes for arpeggio patterns when the pattern generation mode is selected by the first mode selection handler 1033*a*; and a third mode selection handler 1033*c* for performing a changeover between types of replay modes, that is, a one-replay mode in which an arpeggio pattern is replayed once and then the replay is terminated, and a loop replay mode in which an arpeggio pattern is repeatedly replayed, when the musical tone generation mode is selected by the first mode selection handler 1033*a*. The control panel 1033 further comprises a tick set up handler 1033*d* for setting up a real time of a "tick" which is a minimum time unit for scanning an arpeggio pattern; a grid set up handler 1033*e* for setting up the ticks of one array point (grid) in a time axis direction of an arpeggio pattern; a duration set up handler 1033*f* for setting up a "duration" representative of the ratio (%) of the number of ticks actually sounding to the number of ticks included in one grid; a pattern length set up handler 1033*g* for setting up the number of grids of an arpeggio pattern; and other various types of handlers.

Various types of operation information, which are generated by operating various types of handlers provided on the control panel 1033, are fed to the pattern storage unit 1031 and the pattern remapping unit 1032, if necessary.

FIG. 4 is a view showing by way of example an arpeggio pattern generated in the pattern storage unit 1031 shown in FIG. 3.

The arpeggio pattern shown in FIG. 4 has a two dimensional array given by an arrangement of a string number direction and an arrangement (grid) of a time axis direction, and has a various length (n+1) in the grid direction. In the respective coordinates points designated by grids and string numbers, any one of numerals 0–129 is written. Of the numerals 0–129, 0 indicates that the string is not played on the grid, and 1–127 indicate that the string is played on the grid, and in addition a larger numeral indicates that the string is played more. That is, the magnitude of the numeral standby string-playing strength, which corresponds to string-playing data referred to in the present invention. 128 denotes data referred to as a tie data (continuation data referred to in the present invention). The tie data indicates that a performance, based on data of the coordinate point of the grid immediately before the grid whose coordinate point for the same string contains the tie data, is continued up to a grid of the coordinate point on which the tie data is disposed. For example, a tie data (numerical value 128) disposed at coordinates associated with grid 2 and the first string indicates that sounding of a musical tone generated based on data (numeral 64) of the same string (first string) of a grid (grid 1) located immediately before is continued also in a time zone associated with grid 2.

FIG. 129 is end data indicating that the effective arpeggio pattern is up to grid n immediately before the associated grid (n+1).

A method of generating the arpeggio patterns as shown in FIG. 3 will be explained later, and here there will be explained an availability of providing the arpeggio patterns as shown in FIG. 3 referring to a case where one string is prepared, for the purpose of simplification of the explanation, by way of example.

When an arpeggio performance is carried out based on an arpeggio pattern, the respective grids are scanned, for example, at regular intervals. Incidentally, a case where time is varied for each grid will be explained later.

When any one of numerals 1–127 is written in the scanned grid, a musical tone of a pitch by the playing at that time is sounded at the sounding strength associated with the numeral. When numerals 128 (tie data) is read out, the sound of a grid located immediately before the associated grid is continued. When numeral 0 is written in the scanned grid, no sound emanates. An arpeggio performance is effected when those processes are sequentially carried out, and when the vibration of strings stops (in the event that a plurality of strings exist, when all the strings become silent), and the arpeggio performance is terminated. According to the present embodiment, there is provided a one replay mode in which an arpeggio performance is terminated at the time when numeral 129 (end data) is read out from an arpeggio pattern, and a loop replay mode in which when numeral 129 (end data) is read out from an arpeggio pattern, the procedure is returned to the top of the arpeggio pattern so that an arpeggio performance is repeatedly replayed. Thus, when numeral 129 (end data) is read out from an arpeggio pattern while an arpeggio performance is carried out, the arpeggio performance is terminated, or the procedure is returned to the top of the arpeggio pattern so that arpeggio performance is continued, according to the mode set up at that time.

A minimum unit time for scanning an arpeggio pattern is referred to as a "tick". A real time per tick is set up by the tick set up handler 1033*d*. A predetermined number of ticks is set up for each of the grids by the grid set up handler 1033*e*. A grid is valid to play for the time associated with the number of ticks, and after the time elapsed, the process performs the next grid. A scanning rate (arpeggio tempo) of an arpeggio pattern is determined in accordance with an interval (e.g. several seconds) for a real time per tick. It is acceptable that the number of ticks to be set up for each grid is identical for each grid, or alternatively optionally varied for each grid. The grid set up handler 1033*e* has also a function of setting up a different number of ticks for each grid in such a manner that, for example, a different number of ticks is set up for even numbered grids as for odd numbered grids.

Further, according to the present embodiment of the present invention, when an arpeggio performance is effected, it is possible to set up a "duration" through an operation of the duration set up handler 1033*f*. The "duration" is representative of ratio (%) of the number of ticks actually sounding to the number of ticks included in one grid. Setting of a smaller duration makes it possible to play a staccate arpeggio performance. Setting of a larger duration makes it possible to play a tenuto arpeggio performance.

For example, in the event that the following items are set up:

1 tick=0.2 seconds 1 grid=20 ticks

Duration=70% when a sounding instruction to the grid is issued, the sounding occurs during 2.8 seconds=20 (ticks)×0.7 (70%)×0.2 seconds, and a pause is made by 1.2 seconds=20 (ticks)×0.2 seconds−2.8 seconds, and then the process goes to the sounding of the subsequent grid.

Hereinafter, several arpeggio performance patterns will be shown exemplarily.

Figure 5:
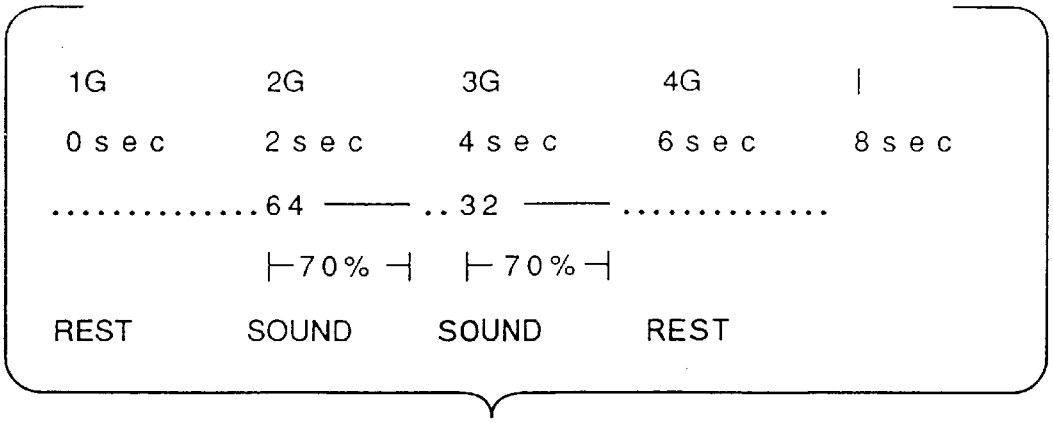
FIG. 5 is a view showing a first example of a performance pattern.

FIG. 5 is a view showing a first example of a performance pattern. In this figure and the following figures, and also in the associated description, it may happen that the "grid" is expressed by an abbreviation "G".

In the event that the following items are given:

1 grid=20 ticks

Duration=70% scanning rate (tempo)=10 ticks /sec the arpeggio performance based on an arpeggio pattern [0, 64, 32, 0] constituted of 4 grids is expressed by a performance pattern as shown in FIG. 5. That is, according to the performance pattern as shown in FIG. 5, in 1G, since data is 0, rest is given; after 2 sec, the process goes to 2G in which the sound emanates at a playing strength 64 by 1.4 sec, that is, 70% of 2 sec of the whole time interval of 2G, and the remaining 0.6 sec rest is given; and then the process goes to 3G in which the sound emanates at a playing strength 32 by 1.4 sec, that is, 70% of 2 sec, and the remaining 0.6 sec rest is given; and then the process goes to 4G in which since data is 0, the rest is given by 2 sec. Thus, after 8 sec, in case of the one replay mode, the arpeggio performance is terminated, and on the other hand, in case of the loop replay mode, the process returns to the top of 1G.

Figure 6:
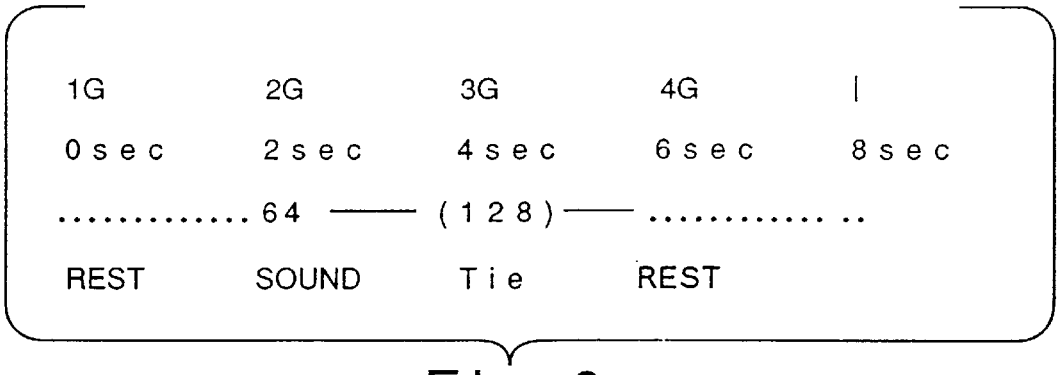
FIG. 6 is a view showing a second example of a performance pattern.

FIG. 6 is a view showing a second example of a performance pattern.

As mentioned above, numeral 128 written in an arpeggio pattern is referred to as "tie data", which implies that the associated grid continues the sounding of the grid located immediately before the associated grid.

In FIG. 6, the arpeggio pattern [0, 64, 32, 0] shown in FIG. 5 is replaced by an arpeggio pattern [0, 64, 128, 0]. According to the performance pattern as shown in FIG. 6, in 1G, since data is 0, the rest is given; after 2 sec, the process goes to 2G in which the sound emanates at a playing strength 64 throughout the entire time interval (2 sec) of 2G since the subsequent grid 3G is involved in the tie data (numeral 128); and then the process goes to 3G in which the sound continuously emanates for a predetermined time based on a duration set up beforehand, and a predetermined rest time is given; and then the process goes to 4G in which rest is given since data is 0. In this manner, when the tie data exists, the immediately previous sound is continued as it is. In other words, when the tie data exists, the duration of sound with respect to the immediately previous grid is regarded as 100%, even though a duration is set up to the value, for example, 70% as shown in FIG. 5, other than 100%. Incidentally, with respect to the grid in which the tie data is written, it is acceptable that as shown in the above-mentioned example, the sounding time is determined in accordance with the duration set up beforehand, or alternatively it is acceptable to provide an arrangement such that the sounding for the grid containing the tie data also emanates at duration 100%.

Figure 7:
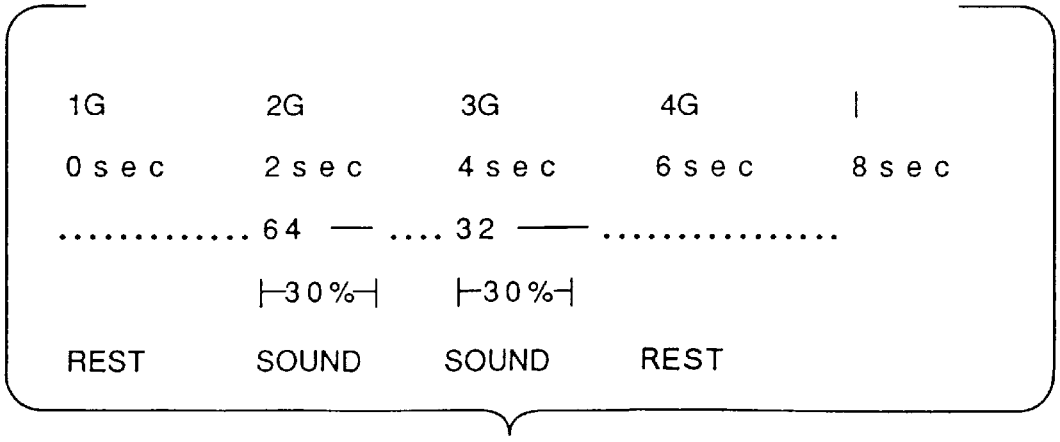
FIG. 7 is a view showing a third example of a performance pattern.

FIG. 7 is a view showing a third example of a performance pattern.

Setting the duration to a small value makes it possible to express a staccate. For example, in the event that the following items are given:

1 grid=20 ticks

Duration=30% scanning rate (tempo)=10 ticks /sec the arpeggio performance based on an arpeggio pattern [0, 64, 32, 0] constituted of 4 grids is expressed by a performance pattern as shown in FIG. 7. That is, according to the performance pattern as shown in FIG. 7, in 2G and 3G, the sound emanates for 0.6 sec, that is, 30% of the whole time interval (2 sec) for each respective 2G and 3G, and the remaining 1.4 sec rest is given, and thus a crisp staccate is expressed.

Figure 8:
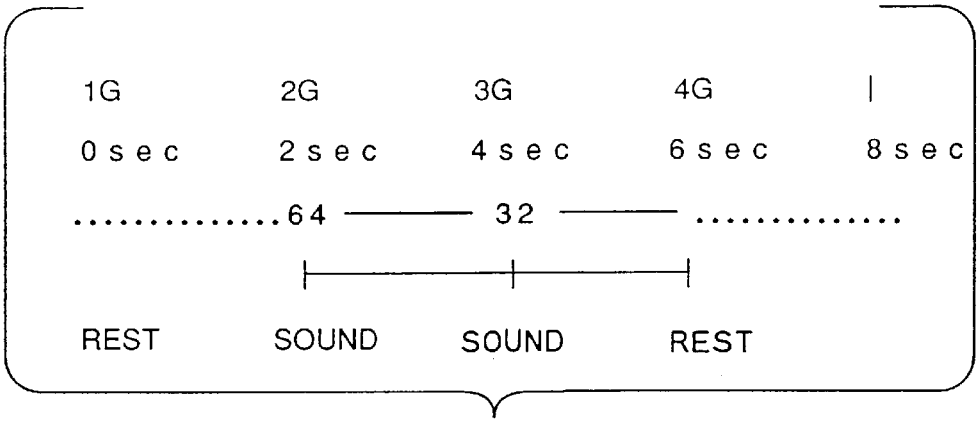
FIG. 8 is a view showing a fourth example of a performance pattern.

FIG. 8 is a view showing a fourth example of a performance pattern.

Setting the duration to a large value makes it possible to express a tenute. For example, in the event that the following items are given:

1 grid=20 ticks

Duration=100% scanning rate (tempo)=10 ticks /sec the arpeggio performance based on an arpeggio pattern [0, 64, 32, 0] constituted of 4 grids is expressed by a performance pattern as shown in FIG. 8. That is, according to the performance pattern as shown in FIG. 8, the sound is continued from the top of 2G to the end of 3G, and thus a smooth tenuto is expressed.

Figure 9:
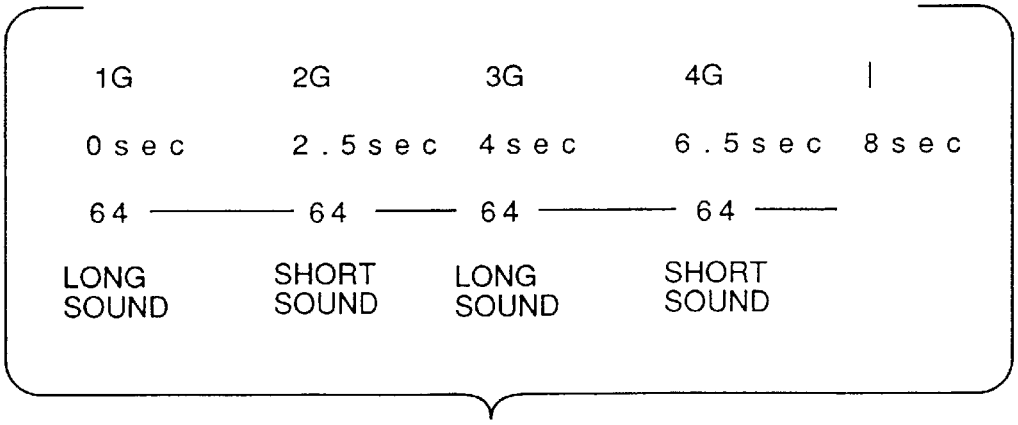
FIG. 9 is a view showing a fifth example of a performance pattern.

FIG. 9 is a view showing a fifth example of a performance pattern.

Differentiating the number of ticks for odd numbered grids and even numbered grids makes it possible to express a shuffle. For example, in the event that the following items are given:

odd grids=25 ticks even grids=15 ticks

Duration=100% scanning rate (tempo)=10 ticks /sec the arpeggio performance based on an arpeggio pattern [64, 64, 64, 64] constituted of 4 grids is expressed by a performance pattern as shown in FIG. 9. That is, according to the performance pattern as shown in FIG. 9, the sound for 1G is 2.5sec; 2G, 1.5sec; 3G, 2.5 sec; 4G, 1.5 sec. In this manner, long sounds and short sounds are alternately repeated, and thus a shuffle is expressed.

As described above, the use of an arpeggio pattern in which string-playing strength (performance strength) is allocated on the respective grids as in the present embodiments makes it possible to effect an arpeggio performance abounding in musical variations through varying a tempo of a replay by means of varying the scanning speed, or varying a beat sense by means of varying the number of ticks, etc. Further it is possible to readily implement an arpeggio performance such that a clock for determining the scanning speed is inputted through an external equipment and synchronization with the external equipment is established.

Hereinafter, there will be explained an input method for the arpeggio pattern as shown in FIG. 3, and an applying method (referred to as "remapping") of applying a performance of the guitar 200 (cf. FIG. 2) to an arpeggio pattern entered for an arpeggio performance.

Figure 10:
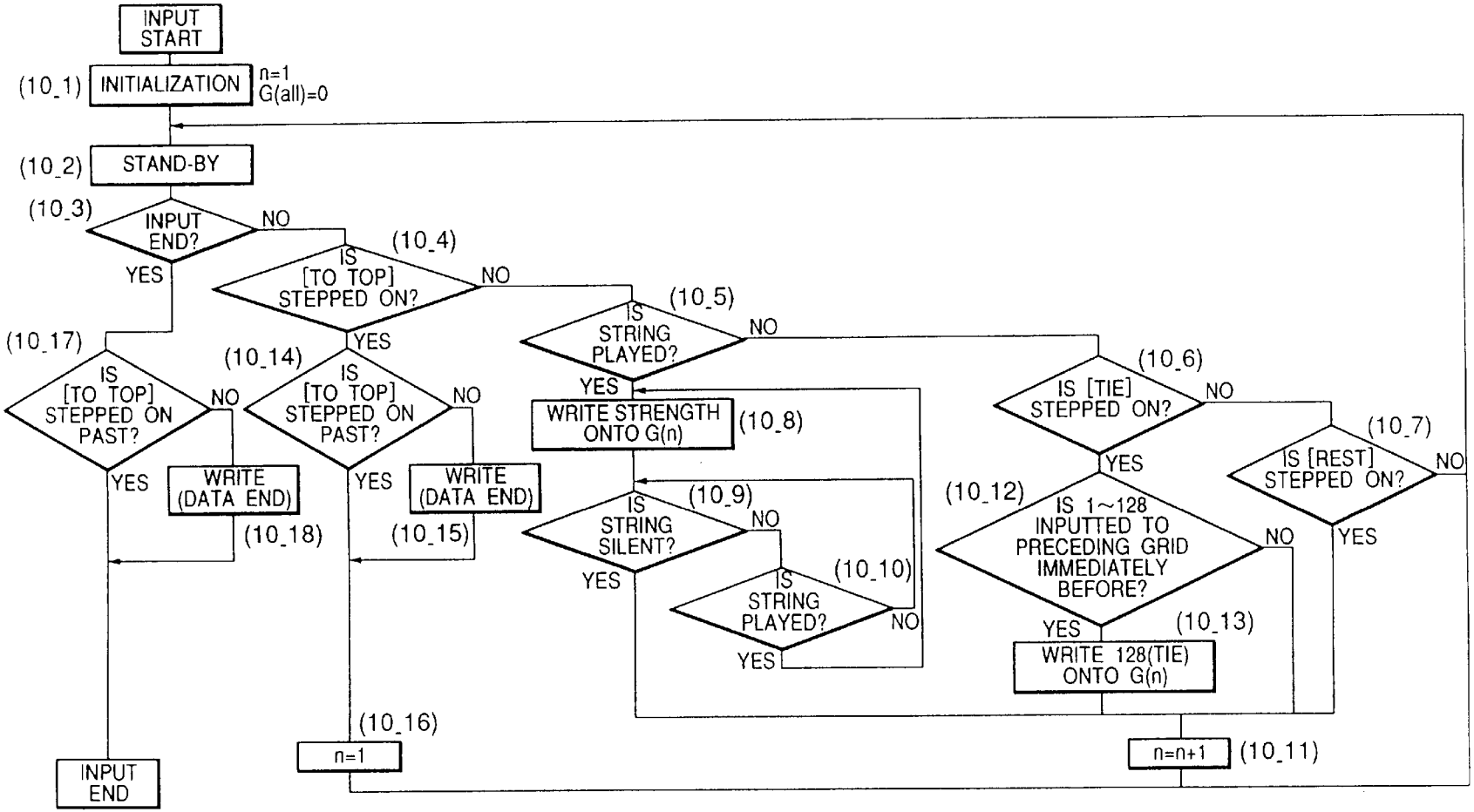
FIG. 10 is a flowchart useful for understanding a scheme of inputting an arpeggio pattern.

FIG. 10 is a flowchart useful for understanding a scheme of inputting an arpeggio pattern.

An electronic musical instrument according to the embodiment of the present invention is provided with three modes as a scheme of inputting an arpeggio pattern. One of these three modes is shown in the flowchart of FIG. 10. This mode may be designated in such a manner that in the condition that the pattern generation mode is designated by the first mode selection handler 1033*a*, the second mode selection handler 1033*b* is operated.

In the mode shown in FIG. 10, of five pedals shown in FIG. 3, that is, [Input start/end] pedal 1031*a*, [Tie] pedal 1031*b*, [Rest] pedal 1031*c*, [To Top] pedal 1031*d*, and [Enter] pedal 1031*e*, four pedals are used [Input start/end] pedal 1031*a*, [Tie] pedal 1031*b*, [Rest] pedal 1031*c*, and [To Top] pedal 1031*d*.

[Input start/end] pedal 1031*a* serves to instruct an input start and an input end; [Tie] pedal 1031*b* serves to instruct to write 128 (Tie data) into a grid associated with a string to which any of numerals 1–128 is applied through a string inputting at the stage of inputting of the immediately previous grid; [Rest] pedal 1031*c* serves to instruct to go to the next grid with nothing to be written (corresponding to writing "a rest" (numerical value 0) since the rest (numerical value 0) is written beforehand according to the present embodiment); and [To Top] pedal 1031*d* serves to instruct to return to the top grid to continue the inputting on an over-write basis.

As mentioned above, according to the present embodiment, while stepping on [To Top] pedal 1031*d* makes it possible to return to the top grip to continue the inputting on an over-write basis, it is to be noted that "the stage of inputting of the immediately previous grid" in the explanation as to [Tie] pedal 1031*b* implies, of the stage of inputting of the immediately previous grid on a location based on the arpeggio pattern shown in FIG. 4 with respect to the grid of interest now to be subjected to inputting, the immediately previous stage of inputting is also on a time basis when [To Top] pedal 1031*d* is stepped on to recurrently perform an inputting. That is, "the stage of inputting of the immediately previous grid" implies "inputtings at a plurality of mutually different time points on the immediately previous grid on a location basis, the immediately previous stage of inputting being also on a time basis".

In the state that the mode shown in FIG. 10 is selected, when [Input start/end] pedal 1031*a* is stepped on, the procedure starts. In step 10_1, an initialization for the generation of a new arpeggio pattern is performed.

In the step for the initialization, a variable n representative of the present grid to which data (numerical value) is to be written is initiated to n=1, and numerical value 0 (rest) is written into all the regions for which an arpeggio pattern is generated (G(all)=0).

After the initialization is carried out, an input standby state is given (step 10_2).

In step 10_2, upon receipt of any input, the process goes to step 10_3 in which it is determined whether [Input start/end] pedal 1031*a* is again stepped on to instruct the input termination. In step 10_4, it is determined whether [To Top] pedal 1031*d* is stepped on. In step 10_5, it is determined whether a string of the guitar 200 is played. In step 10_6, it is determined whether [Tie] pedal 1031*b* is stepped on. In step 10_7, it is determined whether [Rest] pedal 1031*c* is stepped on.

Here, first, there will be explained a case where it is determined in step 10_5 that a string of the guitar 200 is played.

In this case, the process goes to step 10_8 in which a numerical value of 1–127 representative of the string-playing strength of a string is written into the column (coordinate point) associated with the played string of the present grid G (n).

In steps 10_9 and 10_10, it is monitored whether another string is newly played before the vibrating string signal stops. When it is determined that another string is newly played, the process returns to step 10_8 in which a numerical value of 1–127 representative of the string-playing strength of the string is written into a column (coordinate point) associated with the played string of the present grid G (n). In step 10_9, it is determined whether all strings have become silent. When even one of the strings is vibrating, the process goes to step 10_10. When the vibrating string signals for all of strings stop without any strings being newly played, the process goes to step 10_11 in which the grid is renewed, and the process goes to step 10_2 to the input standby state. According to this scheme, numerical values representative of string-playing strength of a plurality of strings which were played until all of the strings have become silent are inputted to the same grid, and thus it is possible to readily input chord data.

When [Tie] pedal 1031*b* is stepped on, the process goes to step 10_12 in which it is determined whether any of numerical values 1–128 (for the sake of convenience, including Tie data 128) is inputted through the string inputting stage for the immediately previous grid at the stage of inputting immediately before also on a time basis. In step 10_13, 128 (Tie data) is written onto the associated column (coordinate point) G(n) of the present grid for only the strings for which any of numerical values 1–128 is written immediately before. In the event that data inputted immediately before is the rest (numerical value 0), or in the event that even if numerical values 1–128 have been inputted in the column (coordinate point) located immediately before, they are not ones inputted immediately before on a time basis. No determination is made in step 10_12. Thus, the process directly goes to step 10_11 in which the grid is renewed, without passing through step 10_13, and then returns to step 10_2 to the input standby state.

When [Rest] pedal 1031*c* is stepped on, the process directly goes to step 10_11 in which the grid is renewed. According to the present embodiment, since the rest data (numerical value 0) has been written beforehand in the initial state of the grid, stepping on [Rest] pedal 1031*c* at the grid into which numerical value 0 has been written corresponds to a generation of the grid of the rest. Of course, stepping on [Rest] pedal 1031*c* at the grid into which 1–128 of string-playing strength (including Tie) has already been written corresponds to a renewal of the number of the grid to which data is to be inputted.

When [To Top] pedal 1031*d* is stepped on, the process goes to step 10_14 in which it is determined whether [To Top] pedal 1031*d* is stepped on also in the past (that is, whether stepping on of [To Top] pedal 1031*d* of the present time is for the second time et seq). In the event that [To Top] pedal1031*d* is stepped on for the first time since the arpeggio pattern was generated, the process goes to step 10_15 in which end data (numerical value 129) indicative of the termination of the arpeggio pattern is written, and then the process goes to step 10_16 in which the procedure returns to the top of grid (n=1).

In the event that [To Top] pedal 1031*d* had been stepped on in the past, the process goes to step 10_16 in which the procedure returns to the top of grid (n=1) without the renewal of the end data since the end data has been written.

When [Input start/end] pedal 1031*a* is stepped on during generation of the arpeggio pattern, the process goes to step 10_17 in which it is determined whether [To Top] pedal 1031*d* had been stepped on in the past. When [To Top] pedal 1031*d* had not been stepped in the past, the process goes to step 10_18 in which the end data is written since the end data had not yet been written, and then the generation of the arpeggio pattern is terminated.

In case of the inputting scheme shown in FIG. 10, simply playing strings makes it possible to readily generate an arpeggio pattern, and the combined use of the pedals makes it possible to input more complicated patterns.

Figure 11:
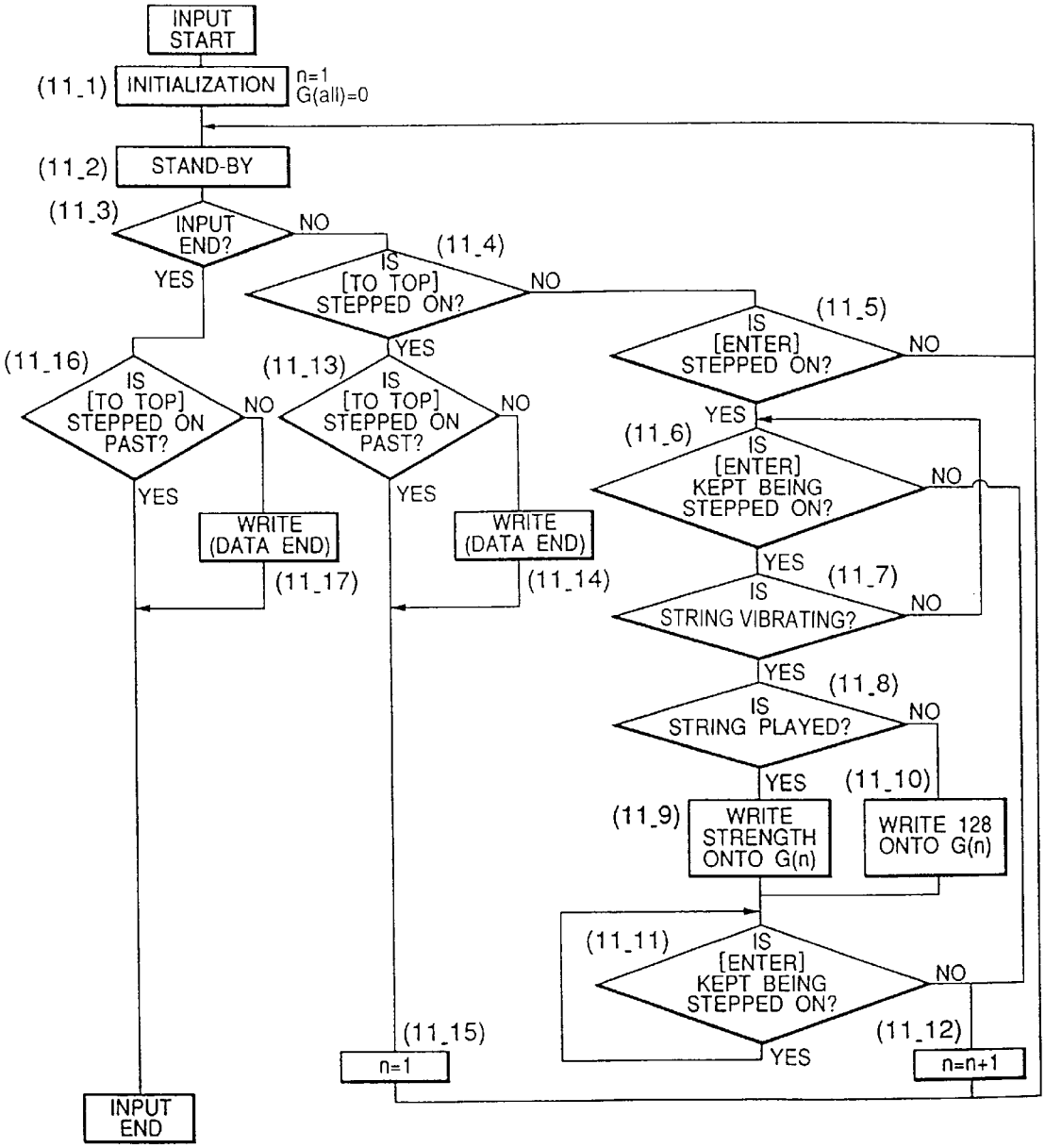
FIG. 11 is a flowchart useful for understanding an alternative scheme of inputting an arpeggio pattern.

FIG. 11 is a flowchart useful for understanding an alternative scheme of inputting an arpeggio pattern.

The mode setting scheme shown in FIG. 11 is similar to that shown in FIG. 10. The mode shown in FIG. 11 is designated through the operation of the first mode selection handler 1033*a* and the second mode selection handler 1033*b*.

In the mode shown in FIG. 11, of five pedals shown in FIG. 3, the pedals used are [Input start/end] pedal 1031*a*, [To Top] pedal 1031*d*, and [Enter] pedal 1031*e*. In FIG. 3, while [Enter] pedal 1031*e* is provided independently of other pedals, it is acceptable that [Enter] pedal 1031*e* and [Tie] pedal 1031*b* or [Rest] pedal 1031*c* are used physically on a common basis to switch over the function in accordance with a changeover between the mode shown in FIG. 10 and the mode shown in FIG. 11.

The functions of [Input start/end] pedal 1031*a* and [To Top] pedal 1031*d* are the same as those in the mode shown in FIG. 10.

[Enter] pedal 1031*e* serves to write data into the associated grid based on the state of strings while this pedal is stepped on, and perform the renewal of the grid at the time when [Enter] pedal 103l*e* is released.

In the state that the mode is switched over to the mode shown in FIG. 11, when [Input start/end] pedal 1031*a* is stepped on, the execution of the flow chart shown in FIG. 11 is initiated. First, in step 11_1, an initialization is performed, and then the process goes to step 11_2 of the inputting standby state.

The initialization in step 11_1 is similar to that of step 10_1, and thus redundant description will be omitted.

In step 11_2, upon receipt of any input, the process goes to step 11_3 in which it is determined whether [Input start/end] pedal 1031*a* is again stepped on to instruct the input termination. In step 11_4, it is determined whether [To Top] pedal 1031*d* is stepped on. In step 11_5, it is determined whether [Enter] pedal 1031*e* is stepped on.

When [Enter] pedal 1031*e* is stepped on, the process goes to step 11_6 in which it is determined whether [Enter] pedal 1031*e* is still now being stepped on continuously. When it is determined that [Enter] pedal 1031*e* is kept in the state of being stepped on, the process goes to step 11_7 in which it is determined whether a string is vibrating.

When it is determined in step 11_6 that [Enter] pedal 1031*e* is released, while step 11_6 and step 11_7 are repeated, the process goes to step 11_12 in which the grid is renewed. That is, when [Enter] pedal 1031*e* is stepped on in timing such that the vibration of strings stops and [Enter] pedal 1031*e* is released in the condition that no string is played, the rest is written into the grid.

When [Enter] pedal 1031*e* is stepped on and a string is vibrating, the process goes to step 11_8 in which it is determined whether the string-playing newly commenced after [Enter] pedal 1031*e* is stepped on. That was, in step 11_8, it is determined whether a determination of string-vibrating in step 11_7 is due to string-playing which occurred after [Enter] pedal 1031*e* was stepped on, or to the fact that the string vibrating by the string-playing was made before [Enter] pedal 1031*e* was stepped on and was continued up to after [Enter] pedal 1031*e* was stepped on.

When the string-playing commences after [Enter] pedal 1031*e* was stepped on, the process goes to step 11_9 in which the string-playing strength of the new played-string is written onto the present grid G (n). On the other hand, when the string vibrating by the string-playing was made before [Enter] pedal 1031*e* was stepped on and was continued up to after [Enter] pedal 1031*e* was stepped on, the process goes to step 11_10 in which 128 (Tie data) is written onto the grid G (n). When a numeral value is written in step 11_9 or step 11_10, the process goes to step 11_11. When [Enter] pedal 1031*e* is released, the process goes to step 11_12 in which the grid is renewed. That is, when [Enter] pedal 1031*e* is stepped on and then a string is played, string-playing strength is written onto the grid G (n). On the other hand, when string singing is continued from the immediately previous grid, 128 (Tie data) is written.

While the above explanation was made about a case of one string, when a plurality of strings exists, it is determined for each string whether the string is played after [Enter] pedal 1031*e* was stepped on, and whether a string vibrating is continued from before [Enter] pedal 1031*e* was stepped on, or the string is silent while [Enter] pedal 1031*e* was stepped on. And for each string, string-playing strength (1–127), Tie data (128) or rest data (0) is written.

In FIG. 11, steps 11_3, 11_4, 11_13, 11_14, 11_16, and 11_17 are the same as steps 10_3, 10_4, 10_14, 10_15, 10_17, and 10_18, respectively. Thus, the redundant explanation will be omitted.

Figure 12:
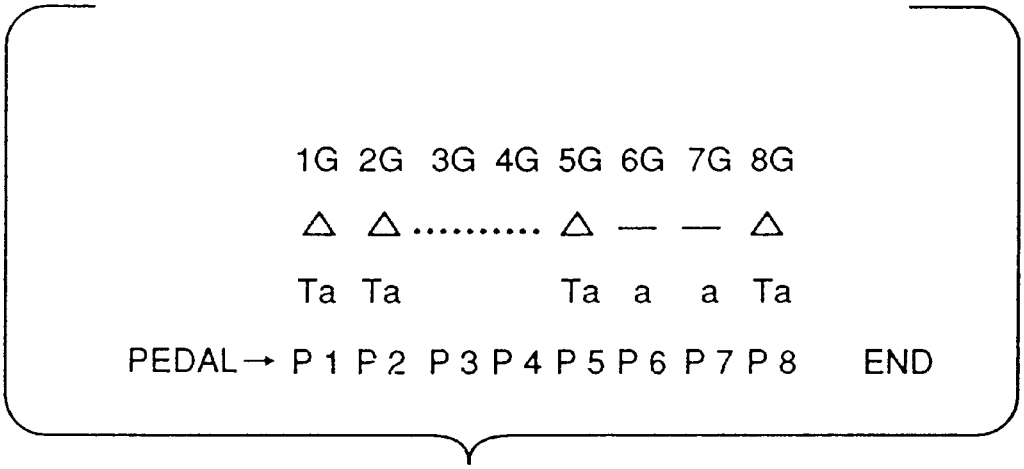
FIG. 12 is an explanatory view useful for understanding an example of inputting using the scheme of inputting shown in FIG. 11.

FIG. 12 is an explanatory view useful for understanding an example of using the scheme of inputting shown in FIG. 11.

In the event it is intended that an arpeggio pattern shown in FIG. 12, (that is, an arpeggio pattern expressed by 1G and 2G: string-playing; 3G and 4G: rest; 5G: string-playing); 6G and 7G: Tie; and 8G: string-playing is inputted, the following performance is made.

1G: In the state that the string is silent, [Enter] pedal 1031*e* is stepped on to play a string, and then [Enter] pedal 1031*e* is released.

2G: The same operation as that of 1G is repeated.

3G: In the state that the string is silent, [Enter] pedal 1031*e* is stepped on, and then [Enter] pedal 1031*e* is released, without playing a string.

4G: The same operation as that of 3G is repeated.

5G: In the state that the string is silent, [Enter] pedal 1031*e* is stepped on to play a string, and then [Enter] pedal is released.

6G: In the state that the string played in 5G is still vibrating, [Enter] pedal 1031*e* is stepped on and then released.

7G: In the state that the string played in 5G is subsequently still vibrating, [Enter] pedal 1031*e* is stepped on and then released.

8G: In the state that the string is silent, [Enter] pedal 1031*e* is stepped on to play a string, and then [Enter] pedal 1031*e* is released.

According to the scheme of inputting shown in FIG. 11, it is possible to input [Tie] and [Rest], without being conscious of those, by means of repeatedly stepping on [Enter] pedal 1031*e*. Thus, it is possible to input a more natural arpeggio pattern of a stringed instrument.

In the event that an arpeggio is played through stringed instruments, a performance pattern of the arpeggio is associated with musical tones having various sounding timings and sounding lengths for each string. Hence, according to the scheme of inputting shown in FIG. 10, it is difficult to input a natural arpeggio pattern without a previous analysis of a pattern to be played to determine beforehand locations of [Tie] and [Rest] to be inserted. However, according to the scheme of inputting shown in FIG. 11, while it requires a some deal of skill as compared with the scheme of inputting shown in FIG. 10, it is possible to input a natural arpeggio pattern without being conscious of locations of [Tie] and [Rest].

Figure 13:
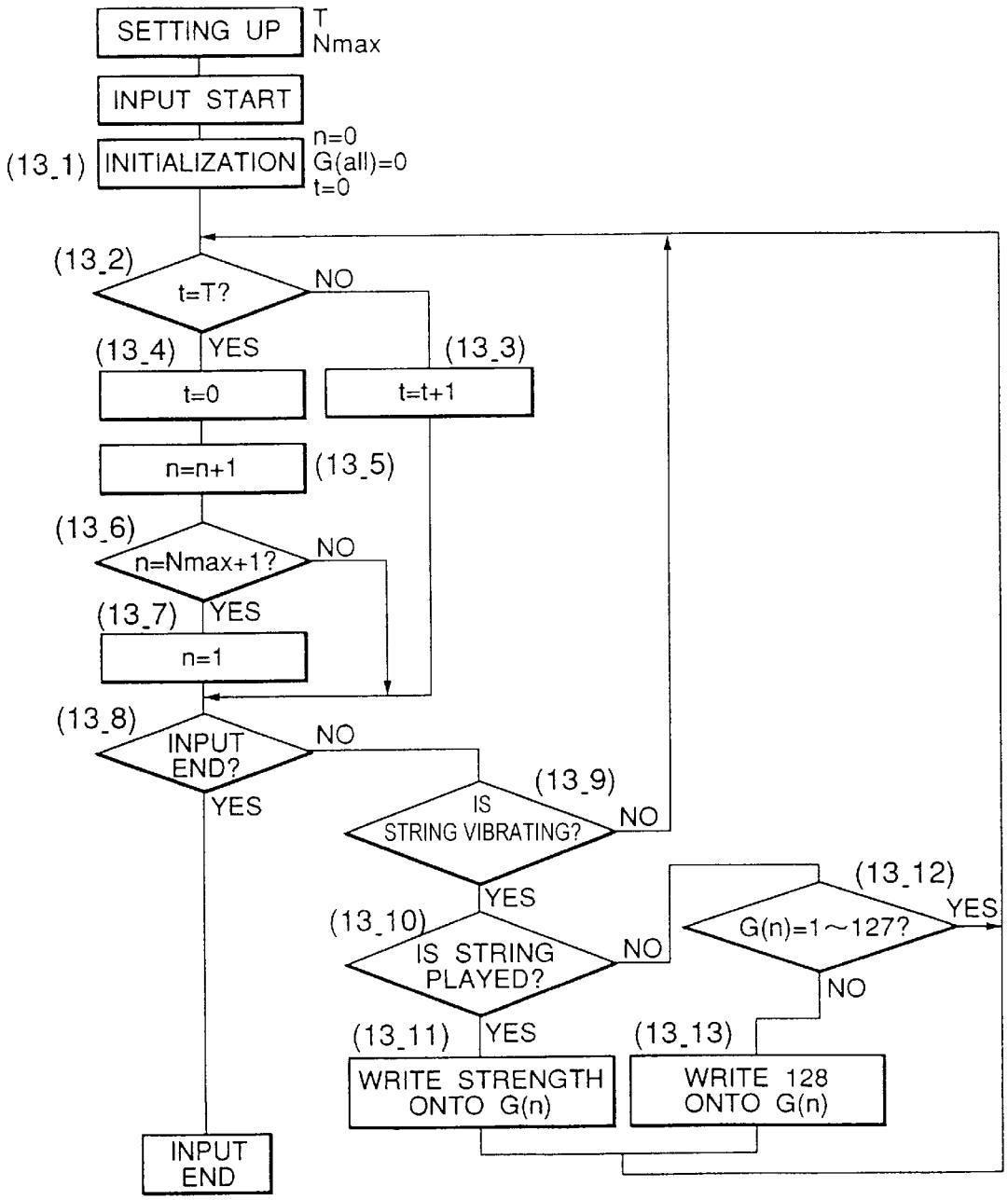
FIG. 13 is a flowchart useful for understanding a further alternative scheme of inputting an arpeggio pattern.

FIG. 13 is a flowchart useful for understanding a further alternative scheme of inputting an arpeggio pattern. The mode setting scheme shown in FIG. 13 is also similar to that shown in FIG. 10 and FIG. 11. The mode shown in FIG. 13 is designated through the operation of the first mode selection handler 1033*a* and the second mode selection handler 1033*b*.

According to the embodiment explained with reference to FIG. 11, it is concerned with an arrangement in which an arpeggio pattern is inputted through an operation by a player while the operator steps on [Enter] pedal 1031*e*. On the other hand, according to the embodiment of FIG. 13, a process corresponding to stepping on [Enter] pedal 1031*e* in time to a predetermined tempo is implemented internally in an electronic musical instrument, and the player inputs an arpeggio pattern in time to the predetermined tempo.

In the mode shown in FIG. 13, of five pedals shown in FIG. 3, only [Input start/end] pedal 1031*a*is used. The function of [Input start/end] pedal 1031*a* is the same as that in each of the modes shown in FIG. 10 and FIG. 11.

In the mode shown in FIG. 13, time T (the number of ticks) per grid is set up by an operation of the grid set up handler 1033*e* shown in FIG. 3 before [Input start/end] pedal 1031*a* is stepped on, and the entire number $N_{max}$ of grids of an arpeggio pattern to be inputted is set up by an operation of the pattern length set up handler 1033*g*. The setting up of the number T of ticks is one by which the control period of [Enter] pedal in the inputting scheme explained in reference to FIG. 11 is replaced. The setting up of the entire number $N_{max}$ of grids is one by which the control period of [To Top] pedal in the inputting scheme explained in reference to FIG. 11 is replaced.

When [Input start/end] pedal 1031*a* is stepped on after setting up the time T and the number $N_{max}$ of grids, the initialization is carried out in step 13_1.

A routine from step 13_4 to step 13_7 is executed once whenever a predetermined short unit time (the number of ticks per grid as mentioned above, where a variable representative of the number of ticks is expressed by t) elapses. First, in step 13_2, it is determined whether t is equivalent to T, that is, it is determined whether it is now the time of renewal of the grid. If t is not equivalent to T, the number t of ticks is incremented (step 13_3), and then the process goes directly to step 13_8. On the other hand, in step 13_2, if it is determined that t is equivalent to T, that is, it is determined that it is now in the time of renewal of the grid, the number t of ticks is reset to t=0 (step 13_4) in order to measure a timing of the renewal of the subsequent grid, and then variable n representative of the present grid is incremented (step 13_5). When the variable n exceeds the number $N_{max}$ of grids (step 13_6), the procedure returns to the top grid (step 13_7).

In step 13_8, it is determined whether the user instructed an inputting termination by the user stepping on [Input start/end] pedal 1031*a*again. When it is determined that an inputting termination is not instructed, the process goes to step 13_9.

In step 13_9, it is determined whether a string is now vibrating, and when it is determined that the string is not now vibrating, the process returns to step 13_2. When it is determined that the string is now vibrating, the process goes to step 13_10 in which it is determined whether a new string-playing occurred after the procedure advanced to the present grid. When it is determined that a new string-playing occurred after the procedure advanced to the present grid, the string-playing strength is written onto the present grid G(n) (step 13_11), and then the process returns to step 13_2. On the other hand, when it is determined that a new string-playing did not occur after the procedure advanced to the present grid, and that it is in the state where the string-vibrating involved in a previous time of execution of steps 13_9 and 13_10 is continued, the process goes to step 13_12 in which it is determined whether any of numerical values 1–127 is written onto the present grid G(n). Step 13_12 is for avoiding a situation where although it is determined in step 13_10 that a string-playing occurred and string-playing strength has been already written onto the present grid G(n) in step 13_11, the written string-playing strength is rewritten, because steps 13_9 and 13_10 are repeatedly executed for each tick also with respect to the same grid. When it is determined in step 13_12 that any of numerical values 1–127 is written onto the present grid G(n), the process directly returns to step 13_2. When G(n)=0, or G(n)=128, the process goes to step 13_13 in which 128 (Tie data ) is written onto G(n), and then the process returns to step 13_2. When a string-vibrating is continued from the immediately previous grid at the time point that the procedure proceeds to the present grid, the the process goes to step 13_13 in which 128 (Tie data ) is written onto G(n) once, and thereafter, when string-playing occurs in the present grid, then in step 13_13 string-playing strength of the string-playing is written.

In a similar fashion to that of FIG. 11, while the above explanation was made about a case of one string, when a plurality of strings exists, it is determined for each string whether the string-vibrating was continued from before the renewal to the present grid, or string-playing occurred after the renewal to the present grid, and it is determined whether a string was silent during a period of time since the renewal to the present grid up to the renewal to the subsequent grid. And for each string, string-playing strength (1–127), Tie data (128) or rest data (0) is written.

When [Input start/end] pedal 1031*a* is again stepped on to instruct the input termination, it is determined in step 13_8 to terminate the inputting, and the inputting process of the arpeggio pattern is terminated.

This structure may avoid the necessity for an operation of pedals by an player. Thus, it is possible to input more readily an arpeggio pattern, since the player can concentrate his thoughts on playing strings and the like.

Incidentally, in the mode shown in FIG. 13, it is preferable that an operator is informed of a timing of the renewal of grids by means of generating a metronome sound or the like in synchronism with the renewal of grids. For this reason, it is effective that for example, when a determination of t=T is made in step 13_2 and it is now time for the renewal of grids, a metronome sound is generated.

According to the inputting scheme for an arpeggio pattern in the two modes explained in reference to FIGS. 10 and 11, with respect to the grid to which Tie data 128 is inputted, the sounding from the immediately previous grid is simply continued. On the other hand, according to the inputting scheme for an arpeggio pattern in the mode explained with reference to FIG. 13, it is possible to overwrite 1–127 of string-playing strength data also with respect to the grid to which Tie data is inputted. As to sounding associated with the grid which is subjected to the overwriting of 1–127 of string-playing strength data on Tie data, the sounding is made in accordance with a new trigger at a string-playing strength associated with the string-playing strength data, but not a simple continuation of sounding of duration 100% from the immediately previous grid. This structure makes it possible to input a greater variety of arpeggio patterns. Incidentally, it is acceptable that also in the modes of FIGS. 10 and 11, the string-playing strength data is overwritten on the Tie data.

Figure 14:
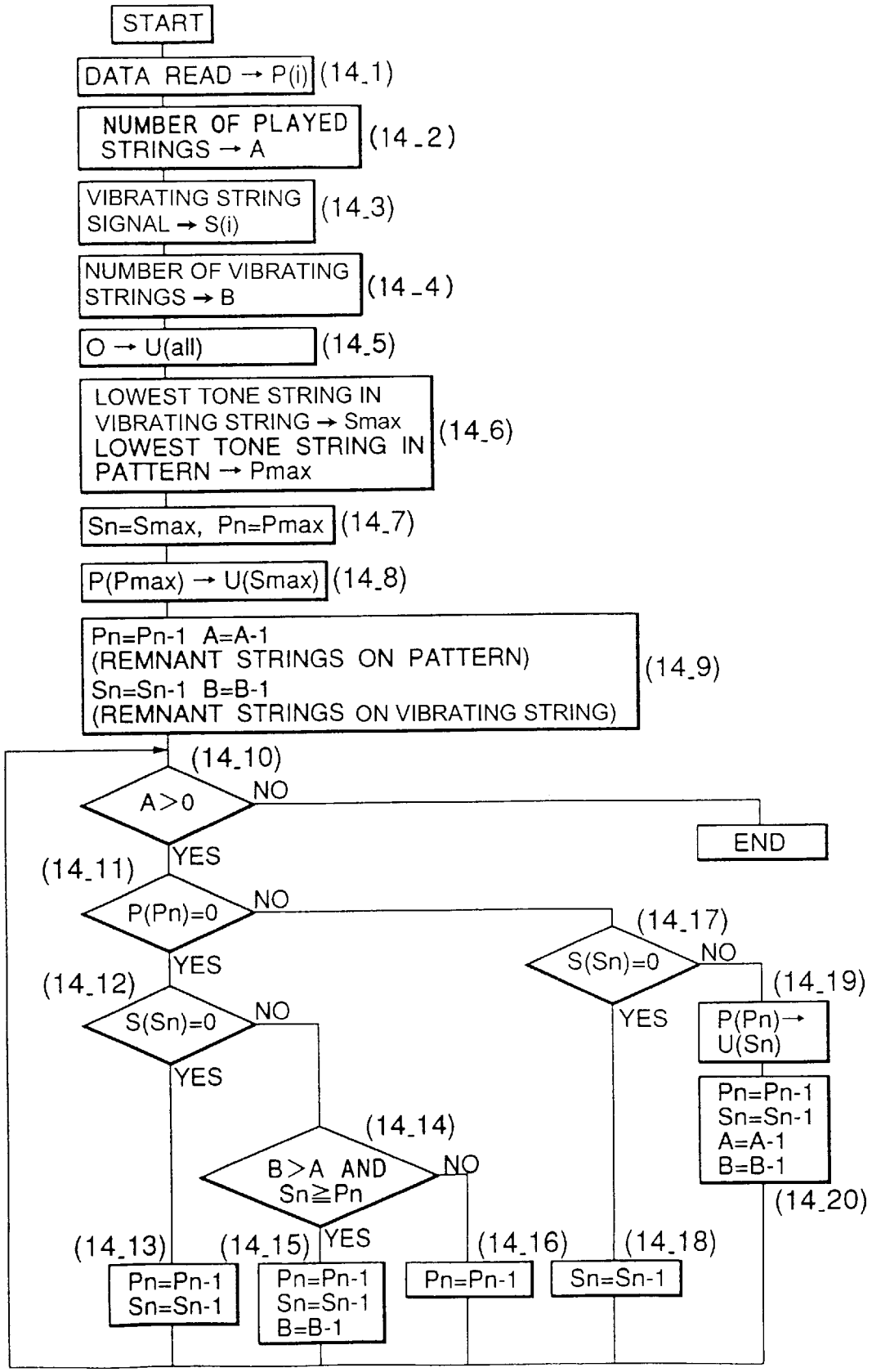
FIG. 14 is a flowchart of remapping.
Figure 20:
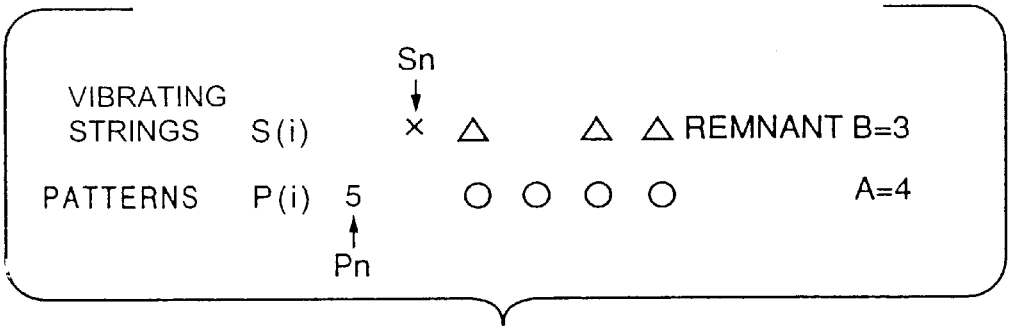
FIG. 20 is an explanatory view showing in order remapping of a certain one pattern.

FIG. 14 is a flowchart of remapping. The flow shown in FIG. 14 is operative when the musical tone generation mode is designated through an operation of the first mode selection handler 1033*a*. It is noted that even if either the one-replay mode or the loop-replay mode is designated by the third mode selection handler 1033*c*, the common process is carried out as far as a particular notice is not given.

When an arpeggio performance is actually conducted with an electronic musical instrument, there is a need to provide musical tone information for an arpeggio pattern inputted beforehand. In order to provide the musical tone information, the guitar 200 (cf. FIG. 2) is played. Mismatch between strings of the arpeggio pattern and strings of the guitar performance for providing pitch information creates problems. For example, it is assumed that six strings exist, and data of the respective strings of [1st string, 2nd string, 3rd string, 4th string, 5th string, 6th string] on a certain grid in the arpeggio pattern are expressed by [0, 0, 64, 32, 72, 0]. In the event that the guitar performance is conducted to provide pitches for those data, when 1st to 3rd strings are played and 4th to 6th strings are not played, this involves a problem as to what pitch of musical tones are to be generated in association with 3rd string, 4th string and 5th string in the arpeggio pattern. According to the flow of FIG. 14, even if there is a mismatch between strings played for a pitch designation and strings in the arpeggio pattern, a compulsory mapping, or a remapping is conducted so as to avoiding such an inconvenience where such a mismatch results in a generation of no musical tone and a generation of lost sound, thereby implementing a musically natural arpeggio performance.

Hereinafter, there will be explained an arpeggio pattern inputted by adopting any of the above-mentioned schemes assuming that the arpeggio pattern undergoes a remapping. It is to be noted, however, that the remapping explained has no relation with the schemes of generation of the arpeggio pattern. It is acceptable that the arpeggio pattern as an object of the remapping is fixedly incorporated into an electronic musical instrument beforehand by the manufacturer of the electronic musical instrument.

Prior to the explanation of the flow of FIG. 14, there will be explained FIGS. 15 to 17 which are necessary for understanding the flow of FIG. 14, and then the flow of FIG. 14 will be explained with reference to FIGS. 15 to 17.

FIG. 15 is a view showing storage areas for data of the respective strings of the present grid read out from an arpeggio pattern, and a working area for storing the number of strings subjected to a string-playing including string-playing strength in the pattern of the present grid. Data of each string i is denoted by P(i), and the number of strings is denoted by A. FIG. 16 is a view showing storage areas for pitch data showing the present performance pattern for a pitch designation, and a working area for storing the number of strings subjected to a string-playing. Data of a pitch of each string is denoted by S(i), and the number of strings is denoted by B. Incidentally, S (i)=0 implies that the i-th string is not played.

FIG. 17 is a view showing string-playing strength of the respective strings after remapping. Data associated with each string i is denoted by U (i).

Here, it is permitted that a plurality of string-playing strength values U (i) is associated with the same played-string. When all of the maximum 6 strings on a certain grid in an arpeggio pattern are involved in a played string (6 strings are filled with any of numerical values 1–127), and a string for providing a pitch is only one string (e.g. 1st string only), then 6 strings of string-playing information is remapped to the one string.

Hereinafter, while the flow of FIG. 14 will be explained, first, the flow of FIG. 14 will be schematically explained, and then the examples shown in FIG. 18 et seq. will be explained.

In step 14_1 of FIG. 14, a pattern of the present grid (hereinafter, it happens that the pattern of the present grid is referred to as an arpeggio pattern, or simply a pattern) of the arpeggio patterns is read out and stored in P (1)–P(6).

Incidentally, the flow of FIG. 14 is a flow for remapping for the present grid. With respect to other respective grids, each grid is scanned at regular intervals in a host flow not illustrated in accordance with a tempo set up so as to read out a pattern of the scanned grid. In the flow shown in FIG. 14, a remapping process is practiced on the pattern of the present grid read out by the host flow. When the end data (numerical value 129) is read out, the remapping is terminated in accordance with the set up mode (the one-replay mode or the loop replay mode), or the procedure returns to the top of the arpeggio pattern to continue the remapping. In this case, the flow shown in FIG. 14 considers no renewal of grids.

In step 14_2, the number of played-strings involving numerical values other than for a rest (numerical value 0) of P(1)–P(6) is counted and written onto A, where Tie data (numerical value 128) is also included in the number of played-strings.

In step 14_3, pitch data of the respective strings are extracted from the present vibrating string signals of the guitar (cf. FIG. 2) and stored in S (1)–S (6) shown in FIG. 16. Incidentally, with respect to the string which is not vibrating during that time at, S(i)=0 is stored. Hereinafter, the string involved in the present guitar performance for a pitch designation is referred to as an "input string", and the string now vibrating of the input strings is referred to as a "vibrating string".

In step 14_4, the number of data other than 0 of S(1) through S(6), or the number of vibrating strings is counted and written onto B.

In step 14_5, 0 is written into all of U(1)–U(6) shown in FIG. 17.

In step 14_6, a string number of the lowest sounding string of the vibrating strings and a string number of the lowest sounding string of the arpeggio pattern are inputted to Smax and Pmax, respectively.

In step 14_7, pointers Sn and Pn are set up to Sn=Smax and Pn=Pmax, respectively.

In step 14_8, P (Pmax) is written into U (Smax). That is, the lowest sounding string of the arpeggio pattern is allotted to the lowest sounding string of the vibrating strings.

In step 14_9, the counting value of the number of strings is counted down (A=A−1, B=B−1), and the respective pointers are renewed (Pn=Pn−1, Sn=Sn−1). It is to be noted that while FIG. 14 does not clearly shows, the renewal of the pointer Sn is performed only when B>0. Hereinafter, with respect to the renewal of the pointer Sn, it is the same as the above.

In step 14_10, it is determined whether A>0, that is, whether there exists a pattern which has not yet undergone the allocation.

In step 14_11, it is determined whether P(Pn)=0 that is, whether the string Pn of the arpeggio pattern is a rest.

In step 14_12, it is determined whether S(Sn)=0 that is, whether the string Sn of the input string is silent.

In step 14_13, the respective pointers are renewed (Pn=Pn−1, Sn=Sn−1).

In step 14_14, it is determined whether B>A, and Sn≧Pn.

In step 14_15, the respective pointers are renewed (Pn=Pn−1, Sn=Sn−1), and B is counted down (B=B−1).

In step 14_16, the pointer Pn is renewed (Pn=Pn−1).

In step 14_17, it is determined whether S(Sn)=0, that is, whether the string Sn of the input string is silent.

In step 14_18, the pointer Sn is renewed (Sn=Sn−1).

In step 14_19, P(Pn) is written onto U(Sn). When data other than the initial value 0 has been written into U(Sn), P(Pn) is written into the neighbor of the data, retaining the data (cf. FIG. 17).

In step 14_20, the respective pointers Pn, Sn are renewed (Pn=Pn−1, Sn=Sn−1), and A and B are counted down (A=A−1, B=B−1).

The flow of FIG. 13 is not as simple to understand. Accordingly, again, the flow of FIG. 13 will be explained along the embodiment, hereinafter.

Each of FIGS. 18–29 is an explanatory view showing in order the remapping of a certain pattern.

As shown in FIG. 18, i=6, 5, 4, 3, 2, 1 denotes numbers of strings; a mark Δ denotes a vibrating string (string now vibrating) of the input string; and a mark ○ denotes that any of numerical values 1–128 is stored in a region (coordinate point) corresponding to string i of the arpeggio pattern (the present grid).

Further, as shown in FIG. 19, Sn and Pn denote pointers now noticed of the input string and the arpeggio pattern, respectively. A mark X denotes the vibrating string which has undergone the allocation. It is to be noted that it happens that the vibrating string undergoes repeatedly the allocation. A figure shown in column of pattern (i) denotes a number of the allocated vibrating string.

It is assumed that in steps 14_1 and 14_3 data as shown in FIG. 18 is obtained.

Here, first, both the lowest sounding strings are located (step 14_6), and those are allocated together (FIG. 19, step 14_8).

Figure 21:
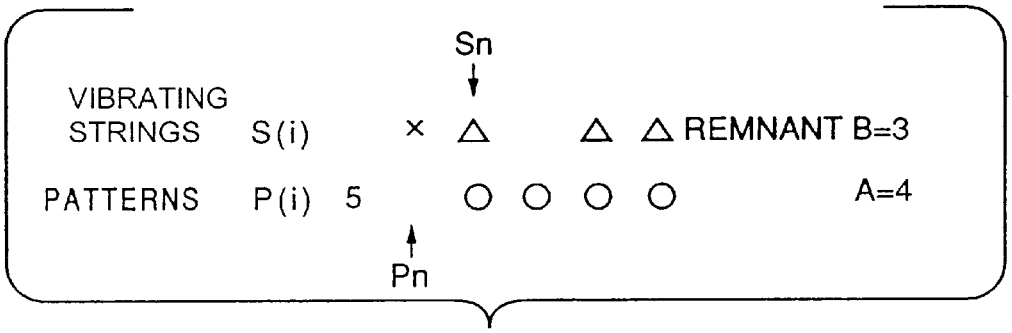
FIG. 21 is an explanatory view showing in order remapping of a certain one pattern.

Next, the number of strings, which do not undergo the allocation, is counted (FIG. 20), and the pointer Pn is advanced. If vibrating strings remain (B>0), the pointer Sn is advanced (FIG. 21; step 14_9).

In the event that data indicated by pointer Pn of the arpeggio pattern is vacant (rest)(step 14_11), if B>A, and Sn≧Pn (step 14_14), both the pointers Pn and Sn are advanced. Here, however, it is not so, only the pointer Pn of the arpeggio pattern is advanced (FIG. 22; step 14_16).

Figure 22:
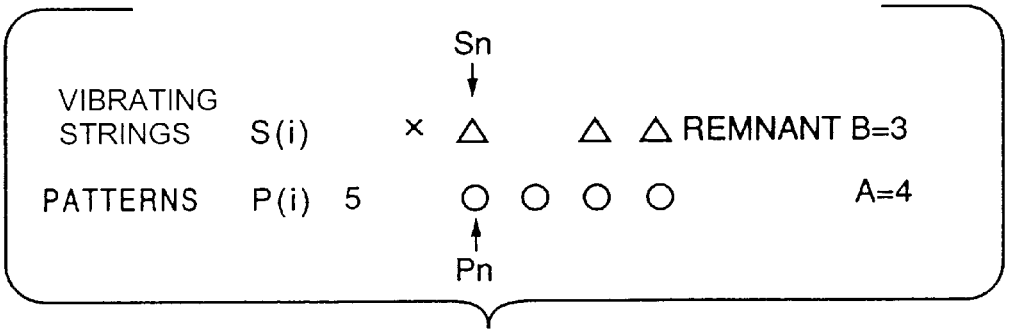
FIG. 22 is an explanatory view showing in order remapping of a certain one pattern.
Figure 23:
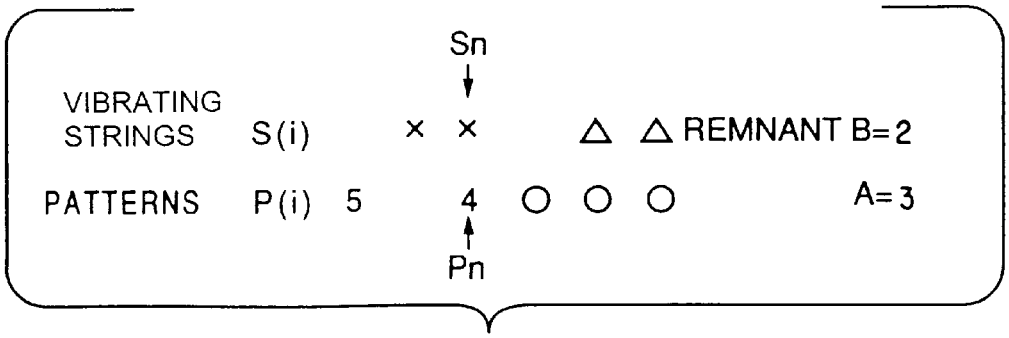
FIG. 23 is an explanatory view showing in order remapping of a certain one pattern.

In FIG. 22, since data are stored in both the pointers Pn and Sn (step 14_11, step 14_17), the allocation is conducted (FIG. 23; step 14_19).

Figure 24:
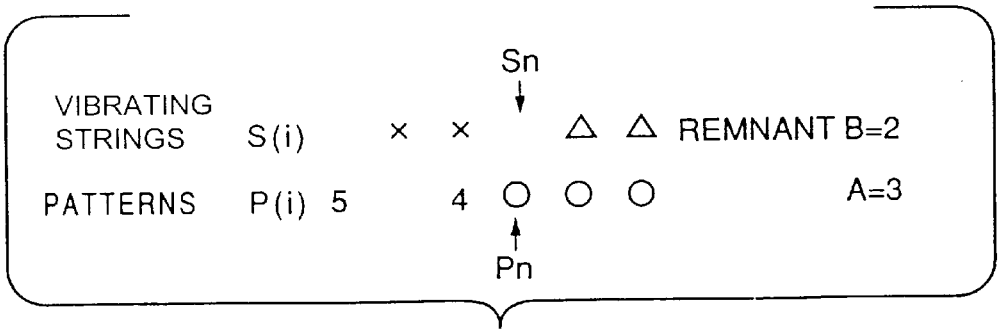
FIG. 24 is an explanatory view showing in order remapping of a certain one pattern.

Next, the pointer Pn is advanced, when B>0, the pointer Sn is advanced (FIG. 24; step 14_20).

Figure 25:
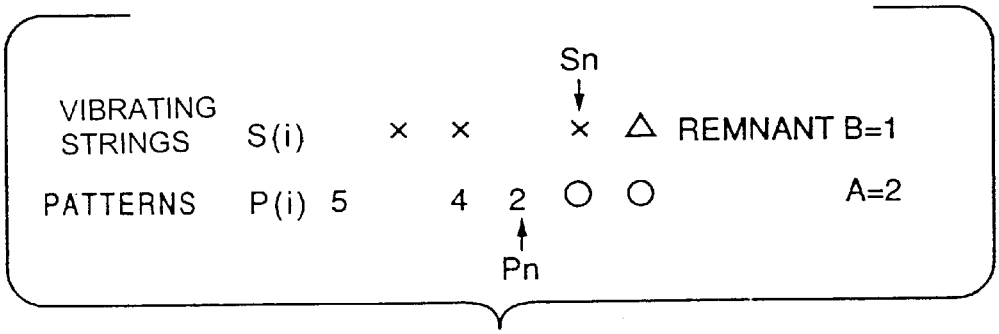
FIG. 25 is an explanatory view showing in order remapping of a certain one pattern.

Here, since the input string is vacant, the pointer Sn of the input string is advanced up to a place with no vacancy (step 14_18), and the allocation is conducted (FIG. 25; step 14_19).

Figure 26:
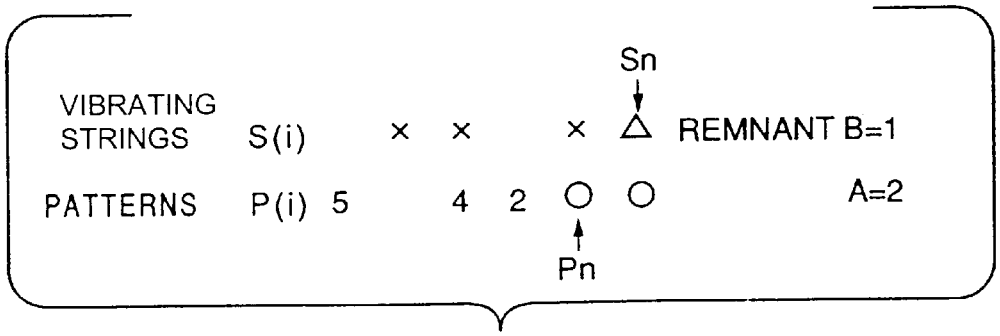
FIG. 26 is an explanatory view showing in order remapping of a certain one pattern.

Further, the pointer Pn is advanced, and if B>0, the pointer Sn is renewed (FIG. 26; step 14_20).

Figure 27:
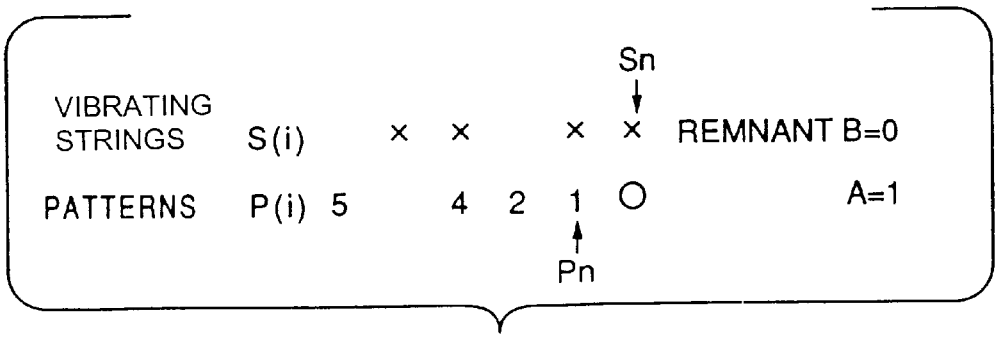
FIG. 27 is an explanatory view showing in order remapping of a certain one pattern.

Since data indicated by both the pointers Pn and Sn are not vacant, the allocation is conducted (FIG. 27; step 14_19).

Figure 28:
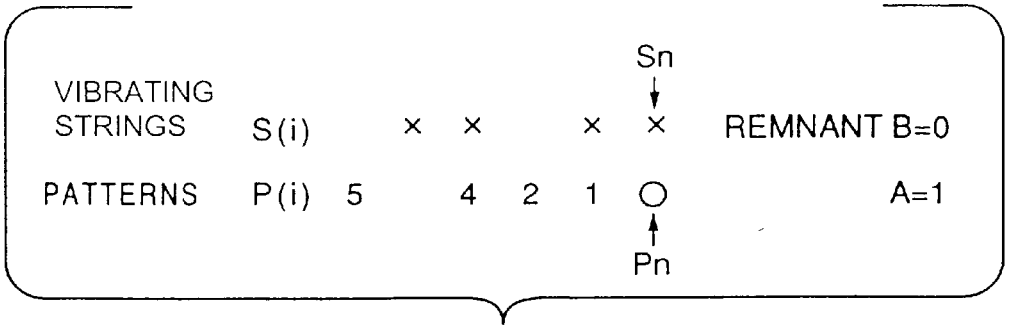
FIG. 28 is an explanatory view showing in order remapping of a certain one pattern.
Figure 29:
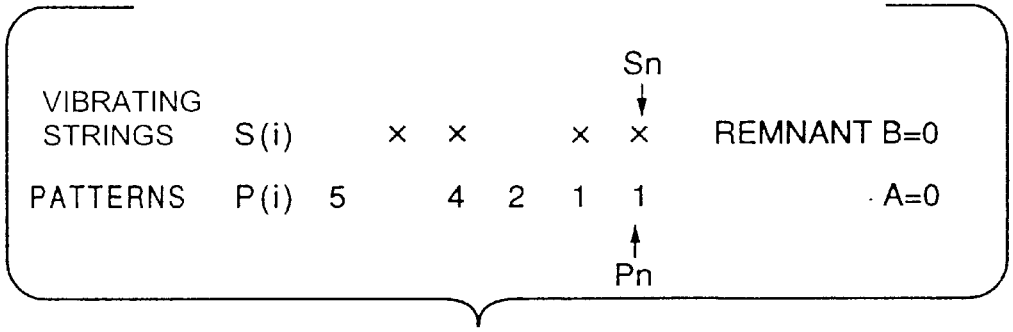
FIG. 29 is an explanatory view showing in order remapping of a certain one pattern.

The pointers Pn and Sn are renewed. It is to be noted that only when the pointer Sn remains (B>0), Sn is renewed, but, here, B=0, hence, Sn is not renewed (FIG. 28; step 14_20).

Further, the allocation is conducted (FIG. 29; step 14_19), and the allocation on the grid noticed is terminated (step 14_10).

Next, there will be explained another example of remapping.

Each of FIGS. 30–38 is an explanatory view showing in order the remapping of a pattern of one grid.

Figure 30:
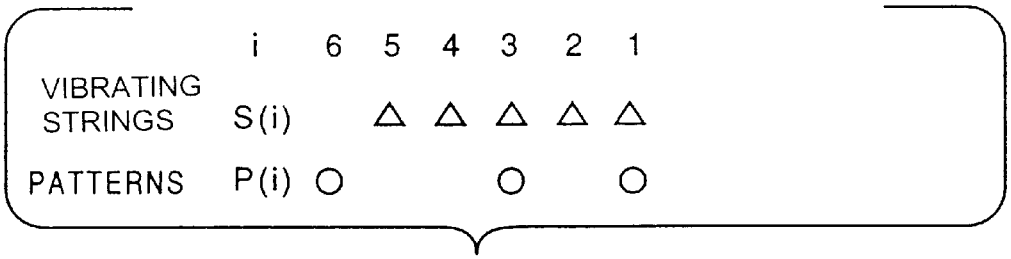
FIG. 30 is an explanatory view showing in order remapping of one pattern.

It is assumed that data shown in FIG. 30 are read (step 14_1, step 14_3).

Figure 31:
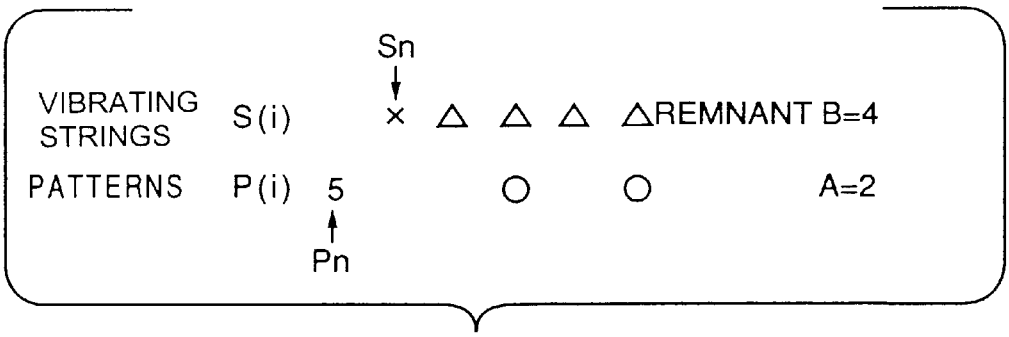
FIG. 31 is an explanatory view showing in order remapping of a certain one pattern.

First, the lowest sounding strings are allocated together (FIG. 31; step 14_6, step 14_8).

Figure 32:
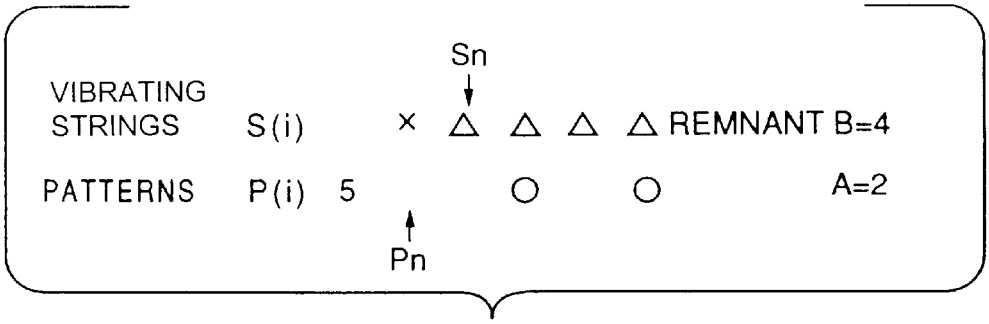
FIG. 32 is an explanatory view showing in order remapping of a one pattern.

Pointers Pn and Sn are advanced (Sn is advanced only when B >0) (FIG. 32; step 14_9).

Figure 33:
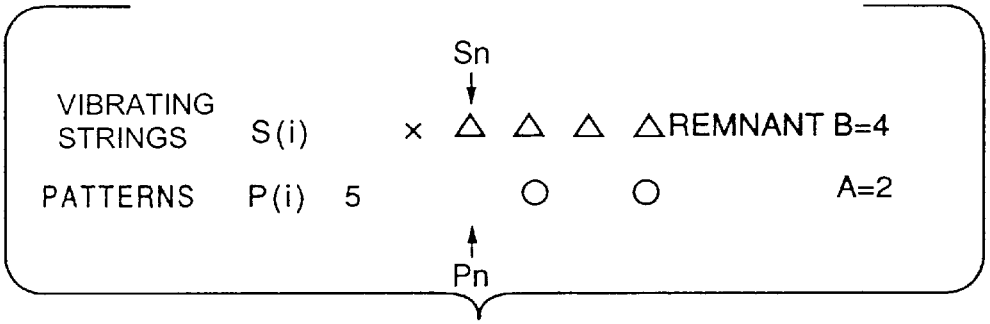
FIG. 33 is an explanatory view showing in order remapping of a one pattern.

Only pointer Pn is advanced (FIG. 33; step 14_14, step 14_16).

Figure 34:
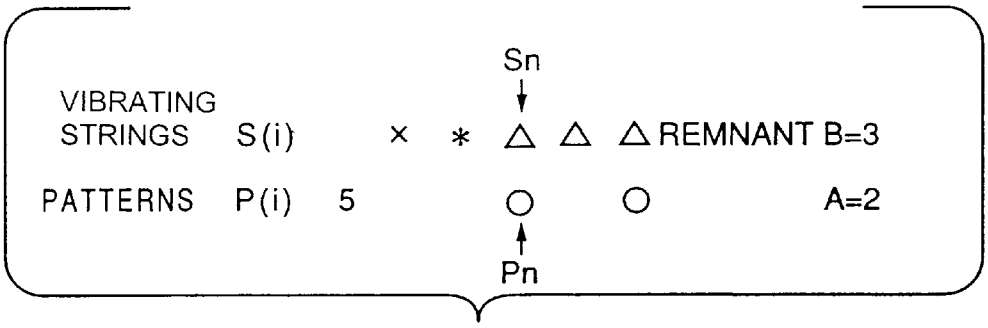
FIG. 34 is an explanatory view showing in order remapping of a one pattern.

Pointers Pn and Sn are advanced (FIG. 34; step 14_14, step 14_15). A mark * denotes that it involves no allocation, and is an excessive vibrating string.

Figure 35:
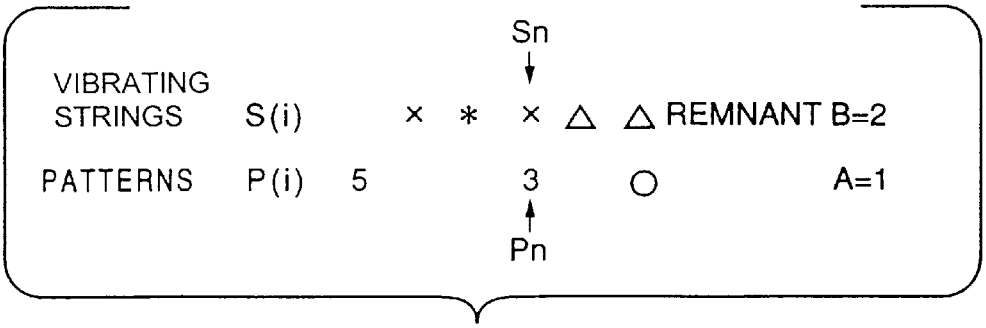
FIG. 35 is an explanatory view showing in order remapping of a one pattern.

The allocation is conducted (FIG. 35; step 14_19).

The pointer is advanced (FIG. 36; step 14_20).

The pointer is advanced (FIG. 37; step 14_14, step 14_15).

The allocation is conducted (FIG. 38; step 14_19).

Thus, the allocation is terminated.

The explanation of the flow of FIG. 14 is terminated.

While the above-mentioned remapping is performed, pitch data of the input string shown in FIG. 16 and remapping data shown in FIG. 17 are entered to the sound source 104 (cf. FIG. 2) in the form of performance information, so that an arpeggio performance is conducted based on the above-mentioned remapping.

In the event that a plurality of string-playing strength values U (i) is associated with the same played-string, it is either acceptable that the sound source 104 generates musical tone signals in accordance with the string-playing strength values U (i), respectively (in this case, these musical tone signals are ones based on pitch information of the same string and thus offer the same pitch), or alternatively the sound source 104 selects any one of the string-playing strength values U (i) and generates a musical tone signal in accordance with the selected string-playing strength value. In this case, it is considered that of the plurality of string-playing strength values U (i) associated with the same played-string, the string-playing strength value U (i) of the highest tone side or the lowest tone side of pattern is selected. Alternatively, it is also considered that the largest one of the plurality of string-playing strength values U (i) is selected, or the mean value of the plurality of string-playing strength values U (i) is evaluated and the mean value obtained is selected.

According to the present embodiment, even if the strings vibrate in any way, sounding is always ensured and thus omission of sounding is prevented whereby an arpeggio performance perceived with less musical incompatibility is conducted.

Further, according to the scheme of remapping shown in FIG. 14, the lowest tone string of the pattern is allotted to the lowest tone string of the vibrating string. In case of the arpeggio of the stringed instrument, frequently there is the case that only the lowest tone string behaves independently of the other strings. Consequently, this allocation scheme is effective.

Furthermore, according to the scheme of remapping shown in FIG. 14, in the event that the arpeggio pattern is a reference, the musical tone to be sounded is associated with the same string or rather higher tone side of string. For example, if a three-strings pattern is concerned, there is a tendency that first to third strings of musical tones are sounded. Specifically, in the event that a performance is conducted through the guitar 200 in such a manner that strings different from the arpeggio pattern are played, this involves a tendency such that the arpeggio performance is conducted shifting to the high tone side. This feature makes it possible to sound clear broken chords, and further to reduce such a possibility that although a musical tone associated with the high tone side, which is important for the arpeggio performance, is played, no sound emanates and thus it comes to nothing.

Each of FIGS. 39–41 is an explanatory view for an allocation method different from that in the flowchart shown in FIG. 14.

It is assumed that data shown in FIG. 39 are read. At that time, first, the allocation of matched strings for both are conducted. Specifically, according to the example shown in FIG. 40, fourth string-to-fourth string, second string-to-second string, and first string-to-first string are allocated together, respectively.

With respect to mismatched strings, the allocation scheme, which has been explained with reference to FIG. 14, is applied. That is, the lowest tone strings of both are allocated together as far as possible, and the played high tone string, which is closest to the string number of the arpeggio pattern, is allocated as far as possible (FIG. 41).

Figure 42:
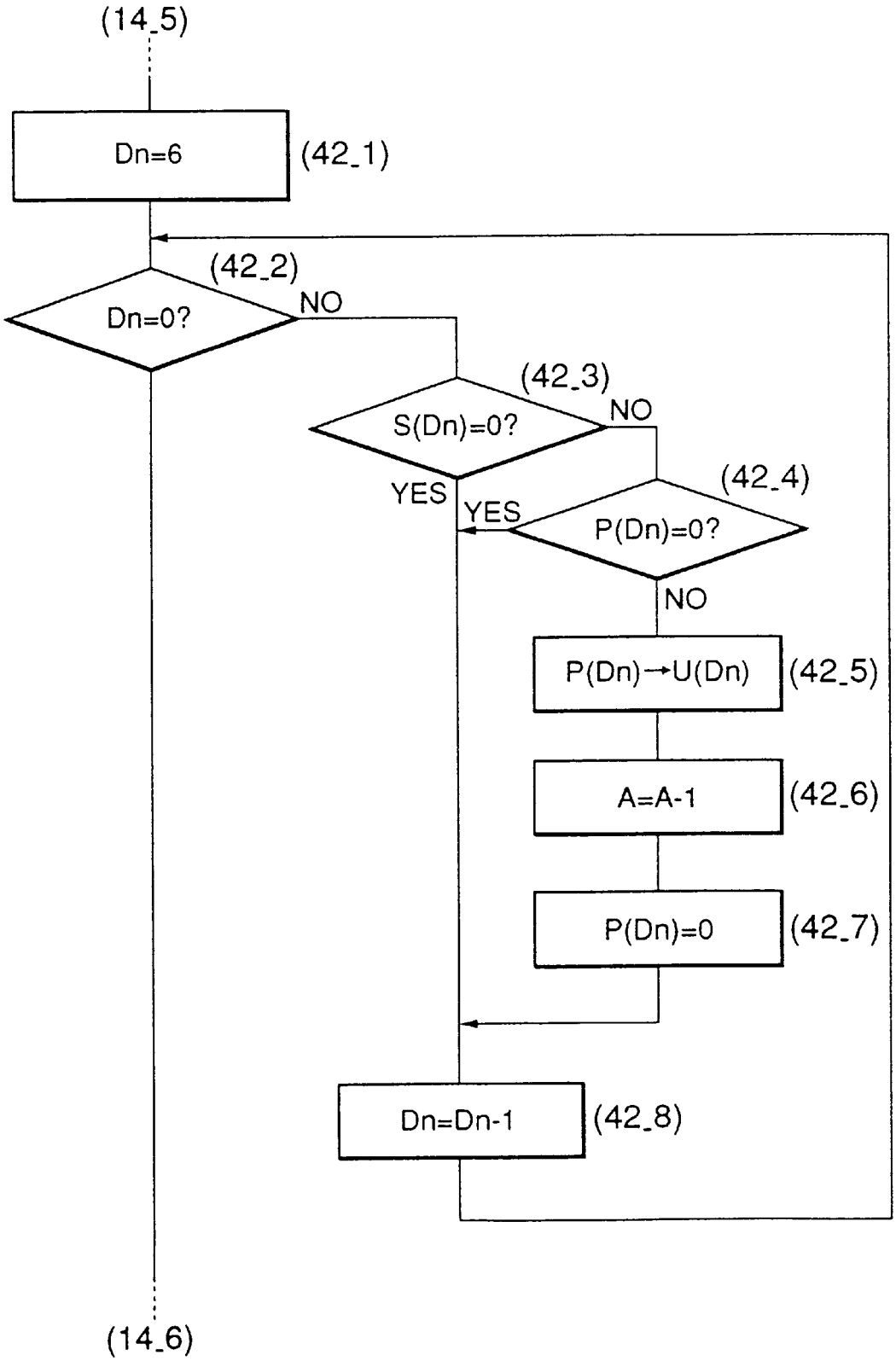
FIG. 42 is a partial flowchart to be added to the flowchart shown in FIG. 14 for implementing the allocation methods explained referring to FIG. 39 to FIG. 41.

FIG. 42 is a partial flowchart to be added to the flowchart shown in FIG. 14 for implementing the allocation methods explained with reference to FIG. 39 to FIG. 41.

The partial flowchart shown in FIG. 42 can be inserted between step 14_5 and step 14_6 of the flowchart shown in FIG. 14.

In step 42_1, a FIG. 6 is set up to a pointer Dn indicating the string number. In step 42_2, it is determined whether Dn=0. In case of Dn≠0, it is determined whether S (Dn)=0 or P (Dn)=0, or S (Dn)≠0 and P (Dn≠0 (step 42_3, step 42_4). In case of S (Dn)≠0 and P (Dn)≠0, since both match with respect to the string Dn, P (Dn) is written onto U (Dn) (step 42_5). In step 42_6, a counting value of played string is counted down (A=A−1). In step 42_7, with respect to the string (Dn) subjected to the allocation, the string-playing strength P (Dn) is rewritten to P (Dn)=0. Further, the pointer Dn indicating the string number is decremented (step 42_8), and then the process returns to step 42_2. In the event that it is determined in step 42_3 that S (Dn)=0, or in step 42_4 that P (Dn)=0, the process goes directly to step 42_8 in which the pointer Dn is decremented, and then the process returns to step 42_2. The above-mentioned process is repeated for each of the string numbers (Dn) 6, 5, . . . 1. When 0 is set to (Dn) in step 42_8 and then the process returns to step 42_2, it is determined that (Dn)=0, and then the process goes to step 14_6 shown in FIG. 14.

The subsequent processing has been already explained with reference to FIG. 14, and thus redundant explanation will be omitted.

In this manner, an adoption of the scheme in which the matched strings are allocated with priority makes it possible to play an arpeggio performance faithful to the original arpeggio pattern as far as possible.

Figure 43:
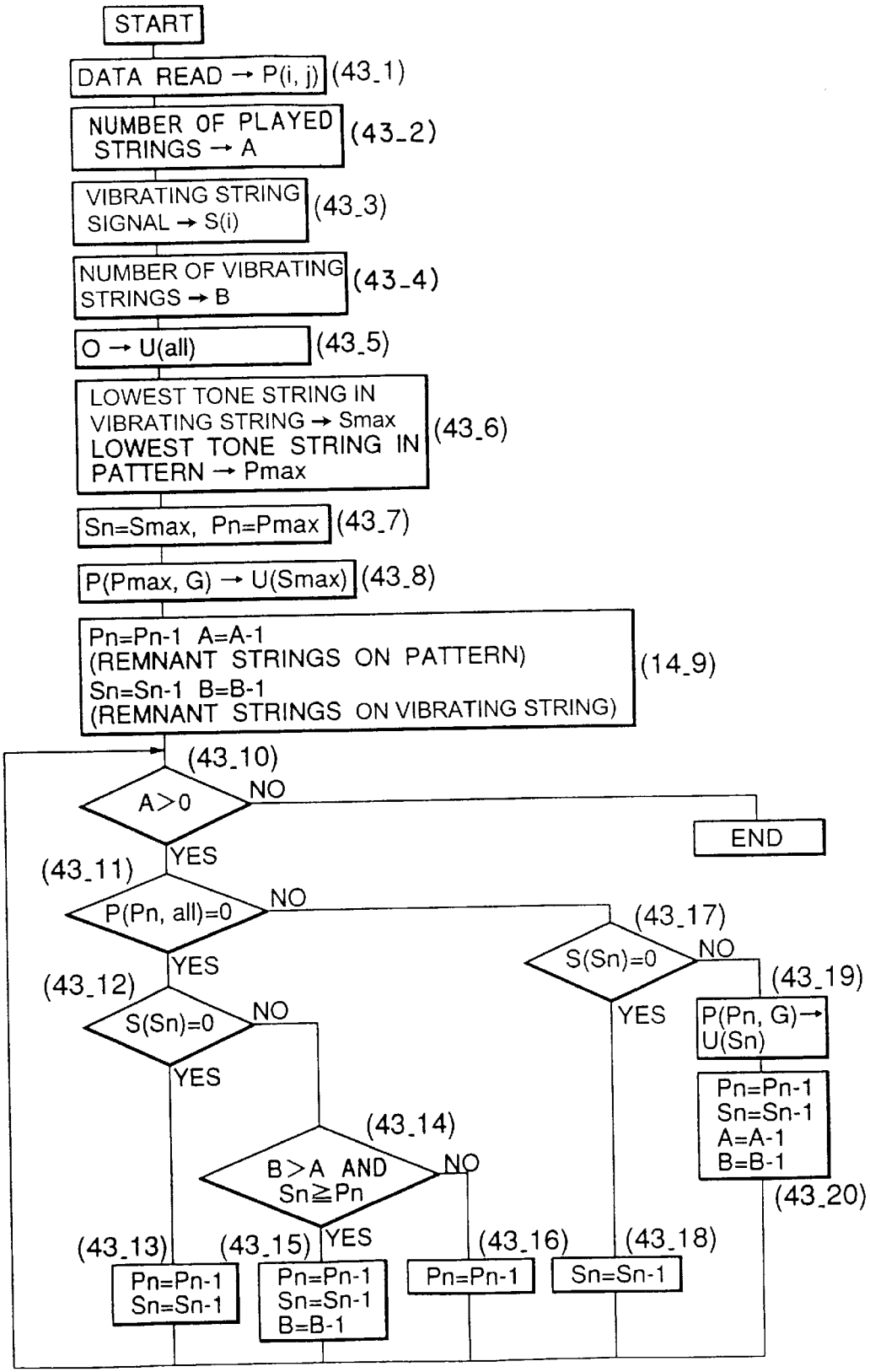
FIG. 43 is a flowchart useful for understanding a further different allocation method of an arpeggio pattern.

FIG. 43 is a flowchart useful for understanding a further different allocation method of an arpeggio pattern. Different points from the flowchart shown in FIG. 14 will be described hereinafter.

Prior to the explanation of the individual steps of this flowchart, an allocation method (remapping processing), which is intended to be implemented by this flowchart, will be explained.

According to the remapping processing shown in FIG. 14, the remapping processing is conducted on each grid so that the lowest tone string of the pattern is always associated with the lowest tone string of the vibrating string. Consequently, in an arpeggio pattern such that only the sixth string (the lowest tone string) sounds on the first grid; only the fifth string sounds on the second grid; only the fourth string sounds on the third grid; . . . , when all of the strings are played for all grids, the musical tone is always generated at the pitch of the sixth string. That is, although the arpeggio pattern intends to produce sequentially higher pitch of strings, actually, the musical tone associated with the lowest tone string is always generated. In such an extreme case, it may involve a musically unnatural feeling.

The flowchart shown in FIG. 43 is to perform a remapping processing to cope with the foregoing. It is noted that the remapping processing is not performed independently of the respective grids, but is performed on a batch basis for all the grids taking the pattern of all grids in their entirety into account. Specifically, in the event that mapping of a pattern of a certain string is conducted, if string-playing strength (1–128) is written onto the pattern of the string in any one of the grids, the played string is associated with the pattern of the string in any grid. While an arpeggio performance is conducted based on an arpeggio pattern, the remapping process is performed whenever the grid is renewed, so as to cope with such matters that a new string-playing is made while the performance is conducted, or that the vibration of the string played is naturally attenuated or compulsively suppressed. Performing the remapping for all grids taking the pattern of all grids in their entirety into account brings about the same result as to mapping between the string number of the arpeggio pattern and the string number involved in the performance in any grid, as far as there does not occur such matters that a new string-playing is made while the performance is conducted, or that the vibration of the string played is naturally attenuated or compulsively suppressed.

Next, the flowchart shown in FIG. 43 will be explained. According to the flow shown in FIG. 43, in a similar fashion to that of the flow shown in FIG. 14, the present grid is sequentially renewed at regular intervals in accordance with the host flow not illustrated.

Here, it is assumed, as shown in step 43_1, that a region for storing string-playing strength data of each string of each grid of an arpeggio pattern is expressed by a two-dimension P (i, j). i denotes, similar to the embodiment shown in FIG. 14, the string number, and j denotes the grid number. Specifically, in step 43_1, the region P (i,j) stores therein patterns of all grids of the whole strings.

Step 43_2 is the same as step 14_2 shown in FIG. 14. In step 43_2, P (i, j) is referred to to determine for each of 6 strings whether a numerical value other than 0 representative of a rest is written into even any one of the grids, and the number of strings except strings in which a rest is written in all grids is written onto A as the number of played strings.

Steps 43_3–43_5 are the same as steps 14_3–14_5 shown in FIG. 14, and the redundant description will be omitted.

Step 43_6 is the same as step 14_6 shown in FIG. 14. In step 43_6, of strings in which a numerical value other than a rest is written onto at least one grid, except strings in which the rest is written on all grids, the string number of the lowest tone side of string (of 6 strings 200_1, 200_2, . . . , 200_6 of the guitar 200 shown in FIG. 2, the string 200_6 is the lowest tone side of string, and the string 200_1 is the highest tone side of string) is written onto Pmax as the lowest tone string. And the string number of the lowest tone string of the strings now vibrating is written onto Smax. Step 43_7 is the same as step 14_7 shown in FIG. 14, and the redundant description will be omitted.

In step 43_8, the string-playing strength P (Pmax, G) of the lowest tone string of the pattern on the present grid designated in the host flow is written onto U (Smax).

Steps 43_9–43_10 are the same as steps 14_9–14_10 shown in FIG. 14, and the redundant description will be omitted.

In step 43_11, it is determined whether all grids P (Pn, all) associated with the strung number Pn of the arpeggio pattern have a rest (numerical value 0).

Steps 43_12–43_18 are the same as steps 14_12–14_18 shown in FIG. 14, and the redundant description will be omitted.

In step 43_19, the string-playing strength P (Pn, G) of the string number Pn on the present grid G is written into U (Sn).

Step 43_20 is the same as step 14_20 shown in Fig.14, and the redundant description will be omitted.

According to the flowchart shown in FIG. 43, while the mapping between the string number of the arpeggio pattern and the string number involved in the performance is conducted whenever the grid is renewed, it is acceptable that such a mapping is conducted only when a new string-playing and a natural attenuation of a vibration of a string or a compulsive suppression of sound occurs, and in a renewal timing of the respective grids, the string-playing strength P of the present grid of the pattern is set up to the string-playing strength U for use in generation of a musical tone signal of the associated string in accordance with the mapping result.

In the above-mentioned embodiments, it is preferable that an arpeggio pattern (it is not a pattern of one grid, but an arpeggio pattern involved in a series of grids as a whole) is tabulated, and tone quality is associated with the tabulated arpeggio pattern and then the mapping is stored. In this manner, the mapping between the arpeggio pattern and tone quality is stored, and when an arpeggio performance is conducted at the tone quality based on the arpeggio pattern subjected to the mapping, it is possible to add variations (special effects) to the tone quality, as will be described hereinafter.

Of tone qualities or tone colors, there is a tone quality having characteristics in a sounding timing. For example, in case of a marimba, there is a tremolo rendition of a marimba. What is meant by a tremolo rendition is generally a style of rendition in which the same tone is repeated closely regularly. Practically, a tone quality such as "Ta, Ta, Ta, . . . " is obtained by closely beating a marimba. Hitherto, it is a general way of obtaining such a tone quality by a PCM sound source that "tone quality emanated by a performance according to a tremolo rendition undergoes a sampling as it is".

However, this conventional scheme brings about a larger amount of data of waves associated with tone qualities to be stored, and also a variation of a timing itself of the tremolo according to a variation of a pitch. Thus, it would be quite different from the actual tremolo rendition.

According to the above-mentioned embodiments, a timing of a sounding such as "Ta, Ta, Ta, . . . " is stored in the form of a pattern of an arpeggio, and the tone quality such as "tremolo marimba" is associated therewith. And the tone quality and the arpeggio pattern are retrieved in combination. This feature makes it possible to implement a tremolo performance of the marimba, without having to store a larger amount of waves. Further, even if a pitch is varied, it is possible to conduct a performance faithfully patterned itself after the actual tremolo performance of the marimba, since the timing of the tremolo determined by the arpeggio pattern is constant.

I claim:

1. An electronic musical instrument comprising:

a pattern generation mode wherein a stringed instrument has a plurality of strings and a plurality of sensors each corresponding to an associated one of the plurality of strings for picking up a vibration of the associated string to generate a vibrating string signal, and a pattern representative of time-elapse change of played strings of said stringed instrument is generated in accordance with vibrating string signals each corresponding to the associated string generated from said stringed instrument;

pattern storage means for storing the pattern in said pattern generation mode, the pattern being defined by an arrangement associated with said plurality of strings and an arrangement associated with a plurality of grids indicative of a direction on a time-elapse basis, wherein each of coordinate points designated by the strings and the grids has string mapping data including information representative of whether a string associated with each of the coordinate points is played in a grid associated with each of the coordinate points;

a musical tone generation mode wherein musical tone signals are generated in accordance with vibrating string signals each corresponding to the associated string, and the pattern stored in said pattern storage means; and data writing means operative in said pattern generation mode for writing string, mapping data into said pattern storage means, including information representative of whether any one of the plurality of strings is played after any one of the strings was played when all of the plurality of strings have stopped vibrating, and before all of the plurality of strings have next stopped vibrating, into respective coordinate points associated with a present grid indicated by a writing pointer indicating grid-direction and also associated with the plurality of strings, and responsive to a cessation of the vibration of all of the plurality of strings for advancing said writing pointer by one in a grid-direction.

2. The electronic musical instrument of claim 1, further comprising a predetermined first handler, wherein said data writing means is in response to an operation of said first handler to write, into coordinate points associated with coordinate points in which string-playing data indicating that a string is played is written of a plurality of coordinate points associated with an immediately previous grid, of a plurality of coordinate points associated with a present grid, continuation data indicating that is said musical tone generation mode, a generation of a musical tone based on string mapping data written into coordinate points associated with an immediately previous grid and also associated with an identical string is continued also on the present grid, and increment said writing pointer by one in a grid-direction.

3. The electronic musical instrument of claim 1, wherein of said string mapping data, string-playing data indicating that a string is played also represents the strength of string-playing.

4. The electronic musical instrument of claim 2, wherein said handler is a manually activated member.

5. The electronic musical instrument of claim 2, wherein said handler is a pedal.

6. An electronic musical instrument comprising:

a pattern generation mode wherein a stringed instrument has a plurality of strings and a plurality of sensors each corresponding to an associated one of the plurality of strings for picking up a vibration of the associated string to generate a vibrating string signal, and a pattern representative of time-elapse change of played strings of said stringed instrument is generated in accordance with vibrating string signals each corresponding to the associated string generated from said stringed instrument;

pattern storage means for storing the pattern in said pattern generation mode, the pattern being defined by an arrangement associated with said plurality of strings and an arrangement associated with a plurality of grids indicative of a direction on a time-elapse basis, wherein each of coordinate points designated by the strings and the grids has string mapping data including information representative of whether a string associated with each of the coordinate points is played in a grid associated with each of the coordinate points;

a musical tone generation mode wherein musical tone signals are generated in accordance with vibrating string signals each corresponding to the associated string, and the pattern stored in said pattern storage means; and a predetermined second handler; and data writing means operative in said pattern generation mode for writing string mapping data into said pattern storage means, including information representative of whether any one of the plurality of strings is played after said second handler is started and before said second handler is terminated, into respective coordinate points associated with a present grid indicated by a writing pointer indicating grid-direction and also associated with the plurality of strings, and responsive to a termination of said second handler for advancing, said writing pointer by one in a grid-direction.

7. The electronic musical instrument of claim 6, wherein in the event that one or more of said plurality of strings is vibrating at the commencement of the operation of said second handler, said data writing means writes, into coordinate points associated with a present grid and associated with the vibrating string, continuation data indicating that in said musical tone generation mode, a generation of a musical tone based on string mapping data written into coordinate points associated with an immediately previous grid and also associated with an identical string is continued on the present grid.

8. The electronic musical instrument of claim 6, wherein of said string mapping data, string-playing data indicating that a string is played also represents the strength of string-playing.

9. The electronic musical instrument of claim 6, wherein said handler is a manually activated member.

10. The electronic musical instrument of claim 6, wherein said handler is a pedal.

11. An electronic musical instrument comprising:

a pattern generation mode wherein a stringed instrument has a plurality of strings and a plurality of sensors each corresponding to an associated one of the plurality of strings for picking up a vibration of the associated string to generate a vibrating string signal, and a pattern representative of a time-elapse change of played strings of said stringed instrument is generated in accordance with vibrating string signals each corresponding to the associated string generated from said stringed instrument;

pattern storage means for storing the pattern in said pattern generation mode, the pattern being defined by an arrangement associated with said plurality of strings and an arrangement associated with a plurality of grids indicative of a direction on time-elapse basis, wherein each of coordinate points designated by the strings and the grids has string mapping data including information representative of whether a string associated with each of the coordinate points is played in a grid associated with each of the coordinate points;

a musical tone generation mode wherein musical tone signals are generated in accordance with vibrating string signals each corresponding to the associated string, and the pattern stored in said pattern storage means; and data writing means operative in said pattern generation mode for writing string mapping data into said pattern storage means, including information representative of whether any one of the plurality of strings is played during a period of time between the last advancement of a writing pointer indicating grid-direction and the present time, into respective coordinate points associated with a present grid indicated by said writing pointer and also associated with the plurality of strings, and for advancing said writing pointer by one in a grid-direction at regular time intervals.

12. The electronic musical instrument of claim 11, wherein in the event that one or more of said plurality of strings is vibrating at a time when said writing pointer is advanced by one in the grid-direction, said data writing means writes, into coordinate points associated with a present grid and associated with the vibrating string, continuation data indicating that in said musical tone generation mode, a generation of a musical tone based on string mapping data written into coordinate points associated with an immediately previous grid and also associated with an identical string is continued on the present grid.

13. The electronic musical instrument of claim 11, wherein of said string mapping data, string-playing data indicating that a string is played also represents the strength of string-playing.

14. An electronic musical instrument wherein a stringed instrument has a plurality of strings and a plurality of sensors each corresponding to an associated one of the plurality of strings for picking up a vibration of the associated string to generate a vibrating string signal, and musical tone signals are generated in accordance with vibrating string signals each corresponding to the associated string, and a pattern representative of time-elapse change of played strings of said stringed instrument, said electronic musical instrument comprising:

pattern storage means for storing the pattern, the pattern being defined by an arrangement associated with said plurality of strings and an arrangement associated with a plurality of grids indicative of a direction on a time-elapse basis, wherein each of coordinate points designated by the strings and the grids has string mapping data including information representative of whether a string associated with each of the coordinate points is played in a grid associated with each of the coordinate points;

data reading means for reading the pattern stored in said pattern storage means;

mapping means for providing a mapping between string-playing data indicating that an associated string is played, of string mapping data associated with said plurality of strings read out from said data reading means, and a vibrating string of said plurality of strings, regardless of whether the string associated with the string-playing data matches the vibrating string; and musical tone generation means for generating a musical tone signal of a pitch of a vibrating string associated with the string-playing data of the string mapping data associated with said plurality of strings read out from said data reading means.

15. The electronic musical instrument of claim 14, wherein said string-playing data indicates that a string is played, and is representative of the strength of string-playing, and said musical tone generation means generates the musical tone signal of a pitch of a vibrating string associated with the string-playing data and of a sounding strength according to the strength of the string-playing indicated by said string-playing data.

16. The electronic musical instrument of claim 14, wherein said mapping means provides a mapping between string-playing data associated with a lowest tone string of the string-playing data read out by said data reading means, and a string associated with the lowest tone string of vibrating strings.

17. The electronic musical instrument of claim 14, wherein said mapping means provides a mapping between string-playing data read out from said data reading means and a vibrating string in such a manner that a maximum number of combinations of string-playing data and the vibrating string identical with a string associated with the string-playing data, or of higher tone side than the string can be obtained.

18. The electronic musical instrument of claim 14, wherein said mapping means provides a mapping between string-playing data read out from said data reading means and a vibrating string in such a manner that a maximum number of combinations of string-playing data and the vibrating string identical with a string associated with the string-playing data can be obtained.

* * * * *